US009976773B2

(12) United States Patent
Stinson et al.

(10) Patent No.: US 9,976,773 B2
(45) Date of Patent: May 22, 2018

(54) CONVECTION HEATER ASSEMBLY PROVIDING LAMINAR FLOW

(75) Inventors: Kelly Stinson, Cambridge (CA); Grant Unsworth, Waterloo (CA)

(73) Assignee: GLEN DIMPLEX AMERICAS LIMITED, Cambridge (CA)

( * ) Notice: Subject to any disclaimer, the term of this patent is extended or adjusted under 35 U.S.C. 154(b) by 1749 days.

(21) Appl. No.: 13/181,029

(22) Filed: Jul. 12, 2011

(65) Prior Publication Data

US 2012/0014678 A1 Jan. 19, 2012

Related U.S. Application Data

(60) Provisional application No. 61/363,815, filed on Jul. 13, 2010.

(51) Int. Cl.
*F24H 3/00* (2006.01)
*F24D 15/02* (2006.01)
(Continued)

(52) U.S. Cl.
CPC ..... *F24H 3/002* (2013.01); *F24H 9/0063* (2013.01); *F28F 13/02* (2013.01);
(Continued)

(58) Field of Classification Search
CPC ..... H01L 21/67109; H05B 2203/032; H05B 2203/016; H05B 2203/023; B60H 1/2225; B60H 1/00471; B60H 1/2218; B60H 1/2221; B60H 2001/2287; F24H 3/0405; F24H 9/2028; F24H 1/102; F24H 3/002; F24H 3/02; F24H 9/0073; F24H 9/02; F24H 9/2071; F24H 1/101; F24H 2250/02; F24H 3/0411; F24H 3/0435; F24H 9/0063; F24H 9/14; F24H 9/2021; F24H 9/2064; F24D 13/024; F24D 19/1096; F24D 2200/08; F24D 3/142; F24D 3/148; F24D 2220/06;
(Continued)

(56) References Cited

U.S. PATENT DOCUMENTS 1,221,422 A * 4/1917 de la Poeze ..... 165/129
1,555,339 A * 9/1925 Vaughan ..... 392/373
(Continued)

FOREIGN PATENT DOCUMENTS

GB 2117505 A * 10/1983 ..... F24D 13/02

*Primary Examiner* — Eric Stapleton
(74) *Attorney, Agent, or Firm* — Carlson, Gaskey & Olds, P.C.

(57) ABSTRACT

A heater assembly to be located at a substantially vertical wall for heating air. The heater assembly includes one or more heating elements, and one or more heat transfer elements mounted on the heating element for transferring heat to a column of the air moving substantially upwardly past the heat transfer elements. The column includes an inner portion positioned proximal to the wall and an outer portion positioned distal to the wall. Each heat transfer element is formed to transfer substantially more heat to the outer portion of the column of the air than to the inner portion thereof, to cause the outer portion to rise faster than the inner portion, for at least partially entraining the inner portion with the outer portion, so that at least a part of the inner portion forms a laminar boundary layer flowing along the wall.

8 Claims, 15 Drawing Sheets

(51) Int. Cl.

| | |
|---|---|
| ***F24H 9/00*** | (2006.01) |
| ***F28F 13/02*** | (2006.01) |
| *F28D 1/053* | (2006.01) |
| *F28F 1/32* | (2006.01) |
| *F28D 21/00* | (2006.01) |

(52) U.S. Cl.
CPC ..... *F24D 2220/06* (2013.01); *F28D 1/05316* (2013.01); *F28D 2021/0035* (2013.01); *F28F 1/32* (2013.01)

(58) Field of Classification Search
CPC ..... F28F 13/02; F28F 1/32; F28D 1/05316; F28D 2021/0035
USPC ..... 219/210, 213, 481, 494, 497, 501, 505, 219/507, 512, 530, 532, 540, 545, 549; 392/352, 356, 365, 368, 370, 371, 374, 392/375, 379, 407, 416, 422, 423, 424, 392/430, 435, 436, 437; 165/104.11, 53
See application file for complete search history.

(56) References Cited

U.S. PATENT DOCUMENTS

| | | | | | |
|---|---|---|---|---|---|
| 1,617,916 | A | * | 2/1927 | Kercher et al. | 392/375 |
| 1,728,377 | A | * | 9/1929 | Trane | 392/307 |
| 1,863,056 | A | * | 6/1932 | Kuenstler | 165/57 |
| 2,200,527 | A | * | 5/1940 | Young | 165/134.1 |
| 2,541,162 | A | | 2/1951 | Hermann | |
| 2,590,336 | A | * | 3/1952 | Mast | 392/370 |
| 2,808,494 | A | * | 10/1957 | Telkes | 126/110 R |
| 2,861,167 | A | * | 11/1958 | Wick | 392/352 |
| 3,091,289 | A | | 5/1963 | Weinstein | |
| 3,111,573 | A | * | 11/1963 | Crowe et al. | 392/363 |
| 3,152,241 | A | * | 10/1964 | Ammerman | 392/370 |
| 3,435,188 | A | * | 3/1969 | Collard | 219/237 |
| 3,449,552 | A | * | 6/1969 | Graves | 219/530 |
| 3,517,730 | A | * | 6/1970 | Wyatt | 165/272 |
| 3,531,623 | A | * | 9/1970 | Teeri | 392/374 |
| 3,605,879 | A | * | 9/1971 | Schaefer, Jr. | 165/55 |
| 3,741,291 | A | * | 6/1973 | Limoni | 165/55 |
| 3,780,797 | A | * | 12/1973 | Gebelius | 165/55 |
| 3,829,656 | A | * | 8/1974 | Temrin | 392/370 |
| 3,847,213 | A | * | 11/1974 | Stich | 165/181 |
| 3,867,981 | A | | 2/1975 | Monroe | |
| 4,227,068 | A | * | 10/1980 | Carter | 392/370 |
| 4,375,590 | A | * | 3/1983 | Janson | 392/347 |
| 4,392,048 | A | * | 7/1983 | Carter | 392/370 |
| 4,514,618 | A | * | 4/1985 | Majthan et al. | 392/379 |
| 4,546,236 | A | * | 10/1985 | Janson | 392/370 |
| 4,587,403 | A | * | 5/1986 | Shapess | 219/209 |
| 4,662,187 | A | * | 5/1987 | Lamb et al. | 62/274 |
| 4,682,009 | A | * | 7/1987 | Meiser et al. | 392/375 |
| 4,784,110 | A | * | 11/1988 | Skafte et al. | 126/110 AA |
| 4,897,524 | A | * | 1/1990 | Brasell | 392/348 |
| 4,937,432 | A | * | 6/1990 | Bertani | 392/370 |
| 4,939,344 | A | * | 7/1990 | Perala | 392/354 |
| 5,047,786 | A | * | 9/1991 | Levy | 392/370 |
| 5,056,501 | A | * | 10/1991 | Ida | 126/110 B |
| 5,092,367 | A | * | 3/1992 | Gilleland | 138/98 |
| 5,092,397 | A | * | 3/1992 | Fuhrmann et al. | 165/151 |
| D330,760 | S | * | 11/1992 | Yoshida et al. | D23/386 |
| 5,197,111 | A | * | 3/1993 | Mills et al. | 392/347 |
| 5,239,610 | A | * | 8/1993 | Shao | 392/363 |
| 5,243,682 | A | * | 9/1993 | Eberts | 392/370 |
| 5,390,731 | A | * | 2/1995 | Selm et al. | 165/152 |
| 5,406,937 | A | * | 4/1995 | Uglietto et al. | 126/659 |
| 5,568,586 | A | * | 10/1996 | Junkel | 392/376 |
| 5,692,291 | A | * | 12/1997 | Deevi et al. | 29/611 |
| 5,761,377 | A | * | 6/1998 | Wolfe et al. | 392/376 |
| 5,909,534 | A | * | 6/1999 | Ko | 392/376 |
| 6,311,015 | B1 | * | 10/2001 | Shih | 392/370 |
| 6,541,743 | B2 | | 4/2003 | Chen | |
| 6,609,664 | B1 | | 8/2003 | Tamhane | |
| 6,707,014 | B1 | * | 3/2004 | Corey et al. | 219/494 |
| 7,195,010 | B2 | * | 3/2007 | Kuroda et al. | 126/116 A |
| 7,238,920 | B1 | * | 7/2007 | Prieto et al. | 219/386 |
| 7,348,522 | B1 | * | 3/2008 | Criscuolo | 219/518 |
| D566,824 | S | * | 4/2008 | Umetsu et al. | D23/386 |
| 7,457,533 | B2 | * | 11/2008 | Hess et al. | 392/356 |
| 8,101,890 | B2 | * | 1/2012 | Wiseman et al. | 219/399 |
| 8,467,668 | B2 | * | 6/2013 | Searle et al. | 392/371 |
| 2003/0150601 | A1 | * | 8/2003 | Park et al. | 165/151 |
| 2005/0274503 | A1 | * | 12/2005 | Gong et al. | 165/151 |
| 2007/0280650 | A1 | * | 12/2007 | Hess et al. | 392/356 |
| 2008/0163763 | A1 | * | 7/2008 | Hoyles et al. | 99/444 |
| 2008/0264404 | A1 | * | 10/2008 | Hoyles et al. | 126/25 R |
| 2009/0285567 | A1 | * | 11/2009 | Searle et al. | 392/371 |

* cited by examiner

CONVECTION HEATER ASSEMBLY PROVIDING LAMINAR FLOW

This application claims the benefit of U.S. Provisional Application No. 61/363,815, filed Jul. 13, 2010, and incorporates such provisional application in its entirety by reference.

FIELD OF THE INVENTION

This invention is related to a heater assembly to be located at a wall in a room.

BACKGROUND OF THE INVENTION

Natural convection heaters, which usually are positioned on a wall (e.g., baseboard heaters), are well known in the art. Typical baseboard heaters of the prior art are shown in FIGS. 1-3. It will be understood that the prior art baseboard heaters as illustrated in FIGS. 1-3 are simplified, for clarity of illustration. (As will be described, the remainder of the drawings illustrate the present invention.)

The flow of air through a prior art baseboard heater 10 is schematically illustrated in FIG. 1. As shown in FIG. 1, the known baseboard heater 10 has several fins 12 for transferring heat to air passing over the fins 12. Typically, the fins 12 are heated by a heating element 14, to which the fins 12 are attached. As is well known in the art, when the air adjacent to the fins 12 is heated due to heat transfer from the fins 12, such air rises. Air at ambient temperature is drawn into the baseboard heater 10 at a lower side thereof accordingly, resulting in circulation of at least a portion of air in the room through the heater 10 due to natural convection.

As schematically illustrated in FIG. 1, when the conventional heater is operating, ambient air from the room ("R") is pulled into the baseboard heater 10 (arrows 22*a*, 22*b*, 22*c*, 22*d*) to replace heated air rising upwardly from the heater. The incoming air schematically represented by arrows 22*a*-22*d* is drawn generally upwardly into the conventional baseboard heater when it is operating, to form a column 44 of generally upwardly-moving air (FIG. 1). The column of heated air exiting the baseboard heater 10 is schematically represented by arrows 22*e*, 22*f*, 22*g*. The air in the room is heated by natural convection. Temperature distributions for the heated air exiting the baseboard heater 10 based on computer modelling (i.e., computational fluid dynamics) are shown in FIG. 1, by regions identified as H1, H2, and H3. The region identified by reference H1 is the hottest region of air. H2 refers to a region at a temperature lower than H1, and H3 refers to a region at a temperature lower than H2. H1, H2, and H3 are represented in FIG. 1 as being defined by isotherms (temperature gradients) respectively, and those skilled in the art will appreciate that in practice such gradients are not fixed in position, but instead vary over time while the conventional heater is operating. For convenience, the isotherms defining the regions are identified as $I_1$-$I_5$ in FIG. 1.

As is well known in the art, the prior art heater 10 shown in FIG. 1 includes a housing 24 defining a cavity 26 in which the heating element 14 and the fins 12 are positioned. Included in the housing 24 are an inner part 28 attachable to the wall 18, and an outer part 30, the inner and outer parts 28, 30 at least partially defining the cavity 26. In one common arrangement, the inner and outer parts 28, 30 also define an upper opening 32 through which the column of heated air exits the baseboard heater 10, and they also define a lower opening 34 through which ambient air enters the baseboard heater 10. It will be understood that, although a grate is typically positioned in the upper opening, the grate has been deliberately omitted from FIG. 1 for clarity of illustration. Typically, ribs (not shown in FIGS. 1 and 2) are positioned at intervals along the length of the baseboard heater to be support elements, e.g., to support a front panel of the heater housing.

As can be seen in FIG. 1, each fin 12 typically is relatively thin and has a generally uniform shape, with substantially flat vertical sides 36, 38 and a substantially straight top side 40 which is substantially orthogonal to the sides 36, 38. The fin 12 also preferably includes a bottom side 41, which is also generally orthogonal to the sides 36, 38. As is well known in the art, the baseboard heater 10 is attached to the wall 18 so that a sufficient distance "$L_1$" is provided between the bottom edge 41 and a floor 19 to permit an adequate flow of ambient air from the room into the heater 10 at the bottom edges 41 of the fins 12.

As indicated in FIG. 1, when moving through the heater 10, the column of rising air 44 is generally contained between an inner surface 29 of the inner part 28 of the housing 24, and an interior surface 31 of the outer part 30.

In another type of conventional baseboard heater 110, a "beak" 142 is included in the housing 124 (FIG. 2). The beak 142 apparently is intended to guide a column of heated air 144 rising from the heater away from the wall and generally toward the center of the room, in order to heat the room "R" more efficiently. The beak 142 is intended to address a concern that the wide upper opening 32 of the conventional baseboard heater 10 (FIG. 1) allows a significant portion of heat from the warmed air to heat the wall, rather than heating the air in the room.

As shown in FIG. 2, the heat transfer fin 112 is generally similar to the fin 12, with a substantially rectangular shape, having substantially flat sides 136, 138, and a substantially flat top side 140 which is orthogonal (or substantially orthogonal) to the sides 136, 138, and a bottom side 141 which is also substantially orthogonal to the sides 136, 138.

The air flow patterns resulting from operation of the baseboard heater 110 (as determined using computational fluid dynamics) are schematically illustrated in FIG. 2. As can be seen in FIG. 2, ambient air is drawn into the baseboard heater 110 when it is operating (schematically represented by arrows 122*a*, 122*b*, 122*c*, 122*d*). The incoming air schematically represented by arrows 122*a*-122*d* is drawn generally upwardly into the conventional heater 110 when it is operating, to form the column 144 of generally upwardly-moving air (FIG. 2). When the heater is operating, the column of air rises and exits the baseboard heater 120 from an upper region thereof (schematically represented by arrows 122*e*, 122*f*, 122*g*, 122*h*). Temperature distributions for the column of air 144 (as determined using computational fluid dynamics) are shown in FIG. 2, the column of heated air 144 rising from the heater being divided into regions J1-J3 (defined by temperature gradients $I_6$-$I_9$) of substantially similar temperature. Those skilled in the art will appreciate that the positions of the temperature gradients shown in FIG. 2 are exemplary only, and that in practice the gradients vary over time when the heater 110 is operating.

Based on the computer modelling (i.e., computational fluid dynamics), it appears that the beak 142 tends to result in a "drag" effect (i.e., the Coanda effect) whereby the heated air is guided so that it is directed almost orthogonally to the wall (see, e.g., arrows 122*e*, 122*f*, 122*g*, and 122*h*).

As is well known in the art, "streaking" (or "staining") often appears on the wall 18 above the baseboard heater 10, after the conventional baseboard heater 10 has been used for a period of time. The phenomenon of streaking does not appear to have been well understood in the prior art. For instance, in U.S. Pat. No. 5,197,111 (Mills, II et al.), it is stated that streaking is due to dust particles that are charred as they pass by the sheathed element (i.e., the heating element) and are carried upwardly by the warmed air (col. 1, lines 40-44). This suggests that the flow of air past the sheathed element and the heat transfer fins leads directly to streaking. According to this understanding of streaking, therefore, the streaking should appear on the wall in the regions between the ribs. However, this does not appear to be the case.

The shaded regions 20 in FIG. 3 represent typical streaking on the wall 18. As can be seen in FIG. 3, streaking typically occurs in regions of the wall 18 generally above ribs 16, rather than between the ribs. This is contrary to the understanding of streaking outlined in Mills, II et al., referred to above.

Also, it has been determined that the regions 20 of the wall 18 above the conventional baseboard heater 10 where streaking occurs are substantially warmer than the rest of the wall, although the regions 20 are substantially above the ribs 26. Temperature gradients (i.e., isotherms) are shown schematically in FIG. 3 which were determined by taking photographs of the wall above a typical prior art baseboard heater using an infrared camera. In short, it appears from FIG. 3 that the ribs 16 affect the flow of heated air upwardly from the conventional heater to make the parts 20 of the wall where streaking occurs warmer than the rest of the wall.

Referring to FIG. 3, the area within the outer temperature gradient "$T_1$" is warmer than the areas outside it. As can be seen in FIG. 3, the area of streaking 20 on the wall 18 is substantially coincident with the temperature gradient $T_1$. A second temperature gradient "$T_2$" is also shown in FIG. 3, and the areas encircled by this temperature gradient are substantially above the ribs 16. The temperature gradient $T_2$ represents a temperature substantially higher than that represented by $T_1$. As can be seen in FIG. 3, therefore, the parts of the wall where streaking occurs are significantly warmer than the other parts of the wall.

Surprisingly, therefore, the warmest parts of the wall above the conventional baseboard heater 10 are the regions 20 immediately above the ribs. This is surprising because, in the prior art (e.g., Mills, II et al.), it had been assumed that the parts of the wall immediately above the ribs would be cooler.

The reasons for this are not clear. It is believed that the ribs disrupt the upward flow of warmed air exiting from between the fins (i.e., possibly due to the Coanda effect), causing turbulence in the upwardly flowing warmed air above the ribs which results in the streaking. Due to the turbulence, the heated air is directed at least partially towards the wall above the ribs. As a result, tiny particles of dust and dirt in the heated air impinge against the wall generally above the ribs 16. Some of these particles adhere to the wall. Over time, these particles accumulate on the wall in the areas 20 above the ribs 16, to result in streaking (i.e., staining).

Based on the foregoing, it appears likely that some turbulence may also develop in the regions between the ribs at the wall above the heater. In short, although there is much uncertainty about the mechanism or mechanisms that create the streaking, it appears that streaking occurs because the ribs disrupt the upward flow of warm air sufficiently that more turbulence is created at the wall above the ribs than in the intervening regions above the heater. As noted above, the addition of a "beak" to the basic prior art design appears to result in even more turbulence at the wall, not less.

SUMMARY OF THE INVENTION

For the reasons set out above, there is a need for a heater assembly which overcomes or mitigates one or more of the defects of the prior art.

In its broad aspect, the invention provides a heater assembly to be located at a substantially vertical wall for heating air in a room at least partially defined by the wall. The heater assembly includes one or more heating elements to provide heat, and one or more heat transfer elements mounted on the heating element for transferring heat from the heating element to a column of the air moving substantially upwardly past the heat transfer elements. The column includes an inner portion positioned proximal to the wall and an outer portion positioned distal to the wall. Each heat transfer element is formed to transfer substantially more heat to the outer portion of the column of the air than to the inner portion thereof, to cause the outer portion to rise faster than the inner portion, for at least partially entraining the inner portion with the outer portion, so that at least a part of the inner portion forms a laminar boundary layer flowing along the wall.

In another aspect, the heater assembly includes a housing at least partially defining a cavity therein in which the heating element and the heat transfer element(s) mounted thereon are receivable. The housing includes one or more inlets through which the air forming the column enters into the housing, and one or more outlets through which the column of warmed air exits the housing.

In another aspect, upward movement of the column of warm air through the outlet is substantially unobstructed, or substantially laminar flow of the column as the column exits the heater assembly.

In yet another of its aspects, the heater assembly additionally includes a grate subassembly having one or more grate elements formed for substantial nonobstruction of the upward movement of the column of air.

In another aspect, the invention provides a heat transfer subassembly for transferring heat to a column of air positioned therein. The heat transfer subassembly is located at a substantially vertical wall, and includes one or more heating elements to provide heat, and one or more heat transfer elements for transferring heat from the heating element to an outer portion of the column, located distal to the wall, and to an inner portion of the column, located proximal to the wall. Each heat transfer element is formed to transfer substantially more heat to the outer portion of the column than to the inner portion thereof, to cause the outer portion to rise faster than the inner portion, thereby drawing the inner portion toward the outer portion so that at least a part of the inner portion forms a laminar boundary layer along the wall.

In another aspect, each heat transfer element at least partially defines a first path along which at least a first segment of the outer portion travels, and a second path along which at least a second segment of the inner portion travels.

In another aspect, the first path is substantially longer than the second path, for transferring more heat to the outer portion than to the inner portion.

In another of its aspects, the invention provides a heater assembly adapted to be located at a substantially vertical wall at least partially defining a room for heating air in the room, the heater assembly including one or more heating elements to provide heat, and a plurality of heat transfer elements mounted on the heating element, for transferring heat from the heating element to a column of the air moving substantially upwardly past the heat transfer elements. Each heat transfer element includes an inner side positionable proximal to the wall and an outer side positionable distal to the wall, when the heater assembly is located proximal to the wall. Each heat transfer element is formed to transfer more heat to an outer portion of the column positioned distal to the wall than to an inner portion of the column positioned proximal to the wall, for causing the outer portion to rise faster than the inner portion and at least partially entraining the inner portion with the outer portion, for laminar flow of at least a part of the inner portion along the wall.

In another aspect, each heat transfer element is formed to position the inner portion at a minimum predetermined distance from the wall as the column exits the heater assembly.

In yet another aspect, each heat transfer element is substantially taller at the outer side thereof than at the inner side thereof, the first and second paths being configured such that the outer and inner portions respectively exit therefrom proximal to the outer and inner sides respectively of the heat transfer elements.

In another of its aspects, the invention provides a method of heating air in a room at least partially defined by a substantially vertical wall, the method comprising the steps of, first, providing one or more heating elements to provide heat, and second, providing one or more heat transfer elements for transferring heat from the heating element to a column of the air adjacent to the transfer element(s). The heat transfer elements are located proximal to the wall. Finally, with the heat transfer element(s), an outer portion of the column of air distal to the wall is heated more than an inner portion of the column of air proximal to the wall, to cause the outer portion to rise faster than the inner portion and at least partially entraining the inner portion with the outer portion, for laminar flow of at least a part of the inner portion along the wall.

In yet another of its aspects, the invention includes a heater assembly adapted to be located at a substantially vertical wall for heating air in a room at least partially defined by the wall. The heater assembly includes one or more heating elements to provide heat, and one or more heat transfer elements mounted on the heating element for transferring heat from the heating element to a column of the air moving substantially upwardly past each heat transfer element. The column has an inner portion positioned proximal to the wall and an outer portion positioned distal to the wall. The heater assembly also includes means for accelerating at least a first segment of the outer portion of the column of the air relative to at least a second segment of the inner portion, to cause the outer portion to rise faster than the inner portion so that the inner portion is at least partially entrained by the outer portion, resulting in laminar flow of at least a part of the inner portion along the wall.

BRIEF DESCRIPTION OF THE DRAWINGS

The invention will be better understood with reference to the attached drawings, in which.

DETAILED DESCRIPTION

Figure 1:
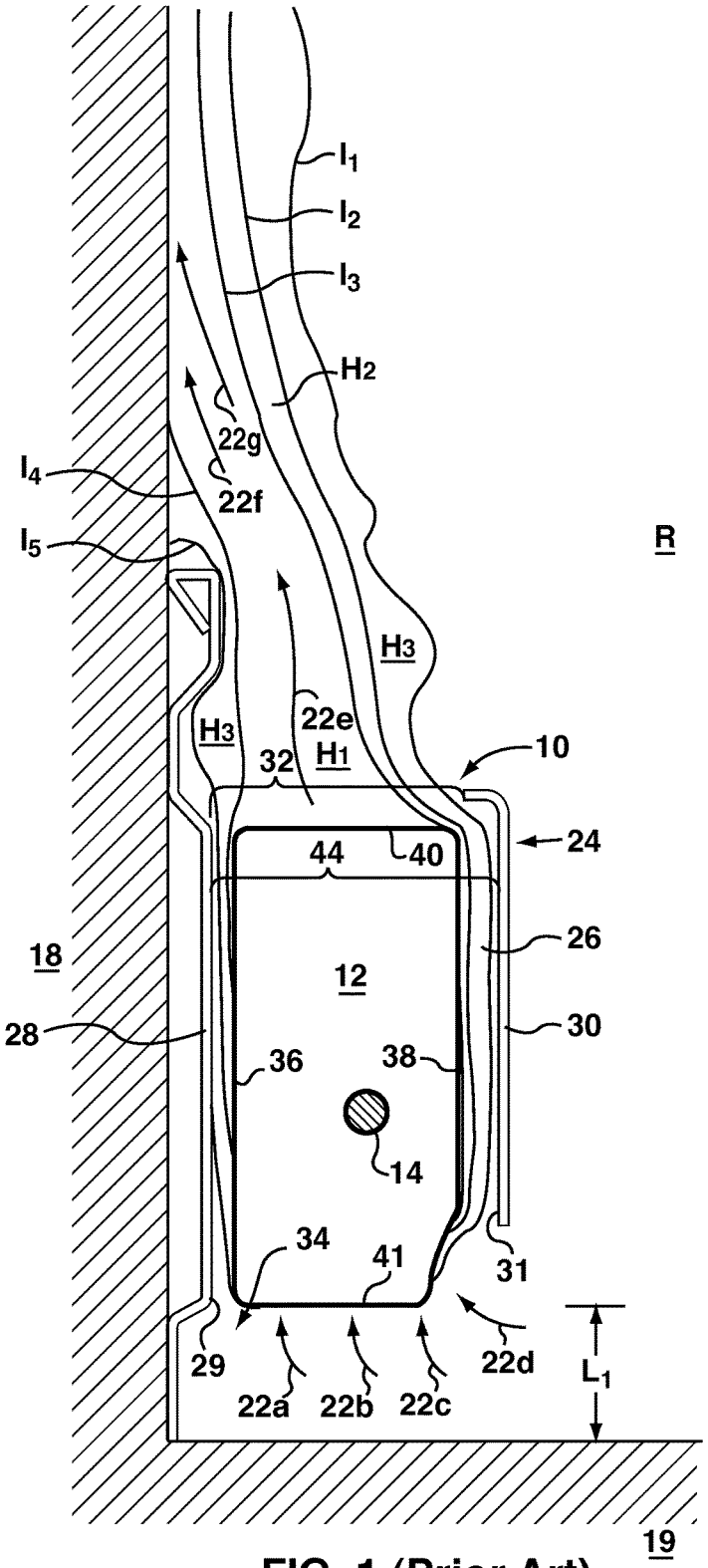
FIG. 1 (Prior Art)
FIG. 1 (also described previously) is a side view of a prior art baseboard heater.
Figure 2:
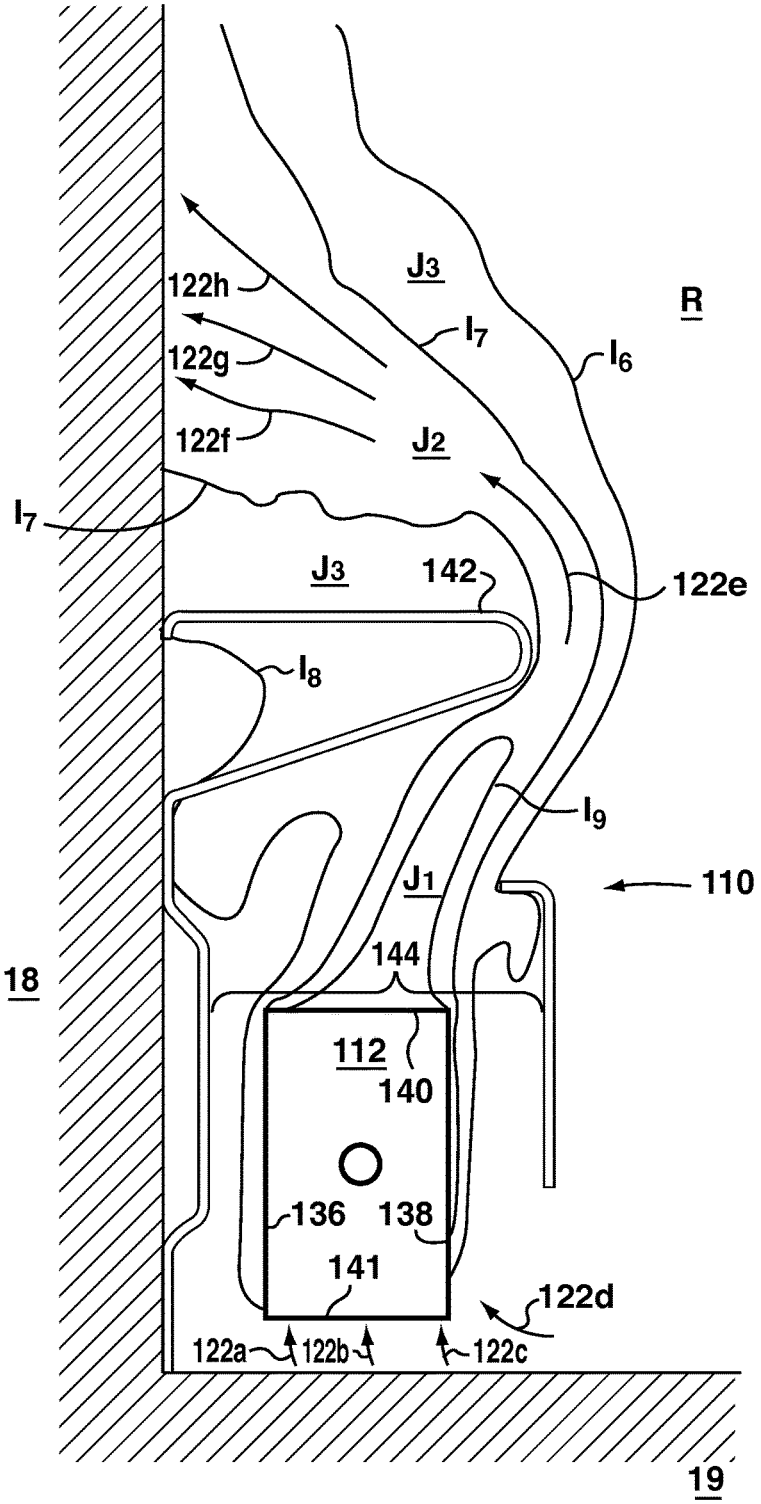
FIG. 2 (Prior Art)
FIG. 2 (also described previously) is a side view of another prior art baseboard heater.
Figure 3:
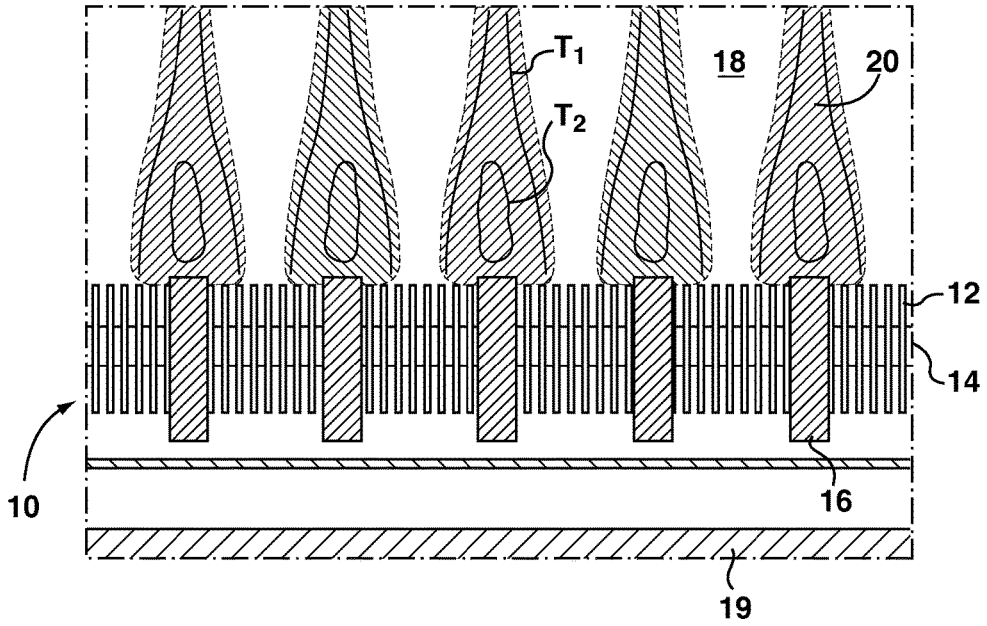
FIG. 3 (Prior Art)
FIG. 3 (also described previously) is a schematic illustration of temperature gradients on a wall above a baseboard heater of the prior art, drawn at a smaller scale.
Figure 4:
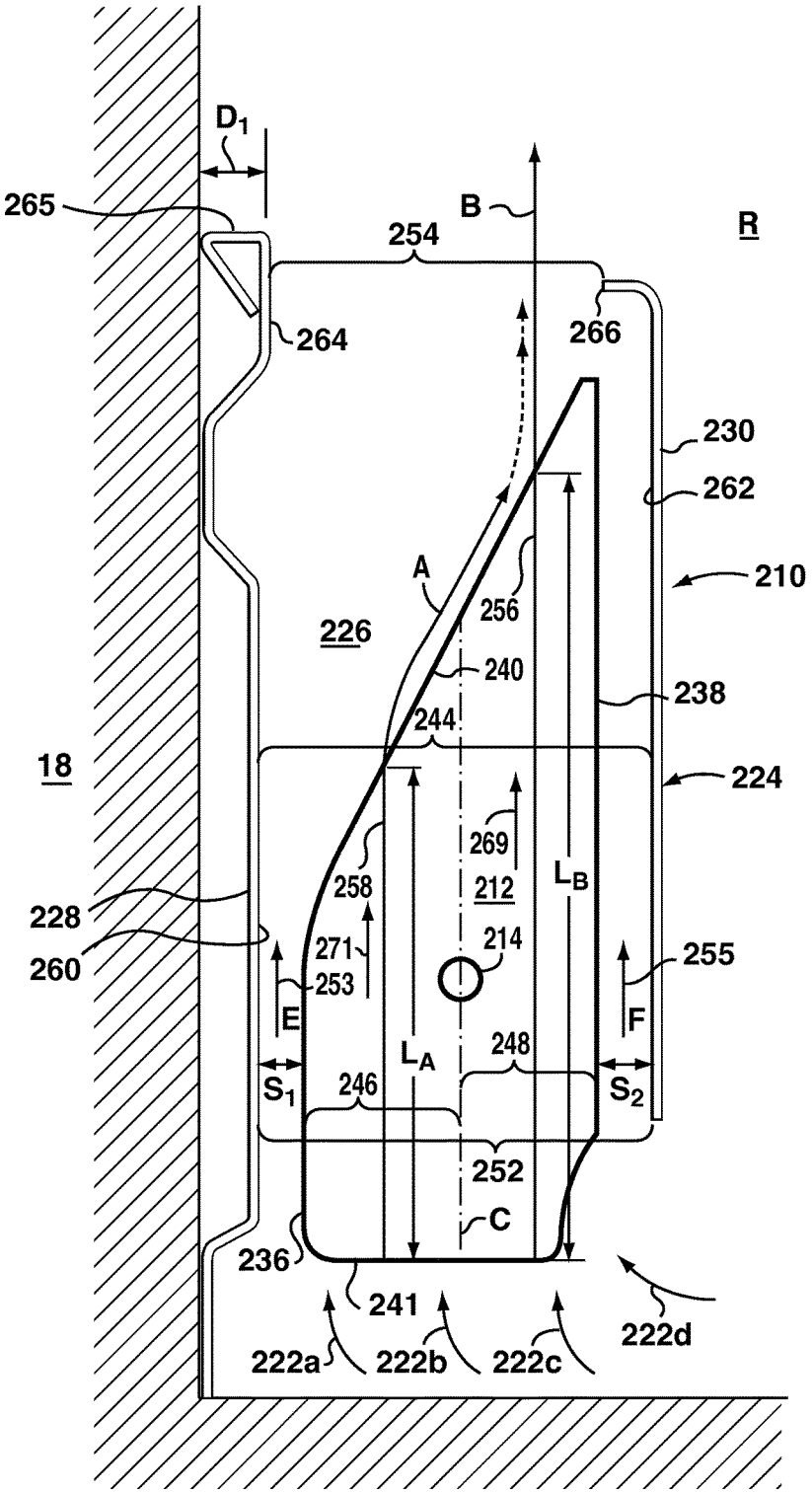
FIG. 4 is a side view of an embodiment of the heater assembly of the invention, drawn at a larger scale.
Figure 5A:
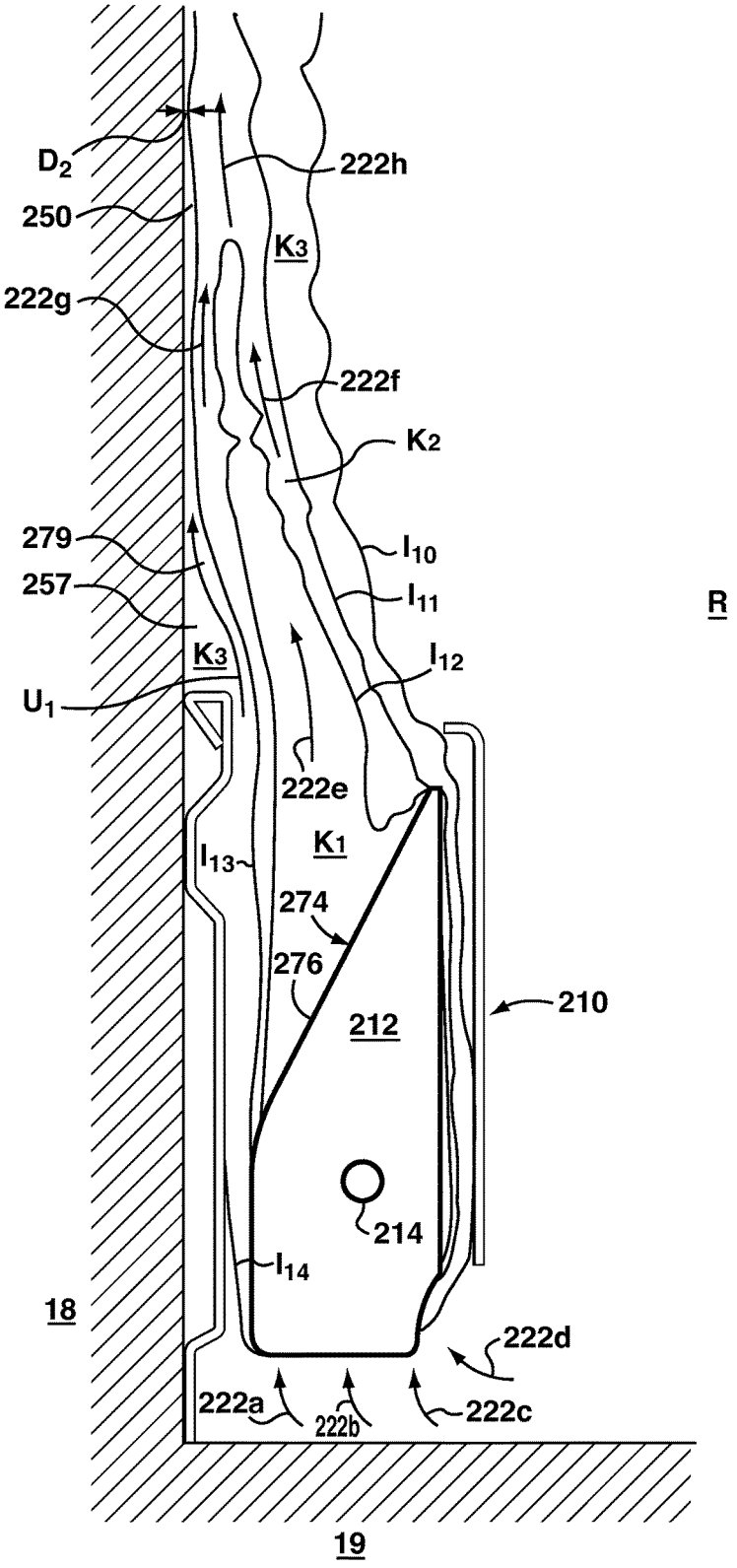
FIG. 5A is a side view of the heater assembly of FIG. 4, drawn at a smaller scale.
Figure 5B:
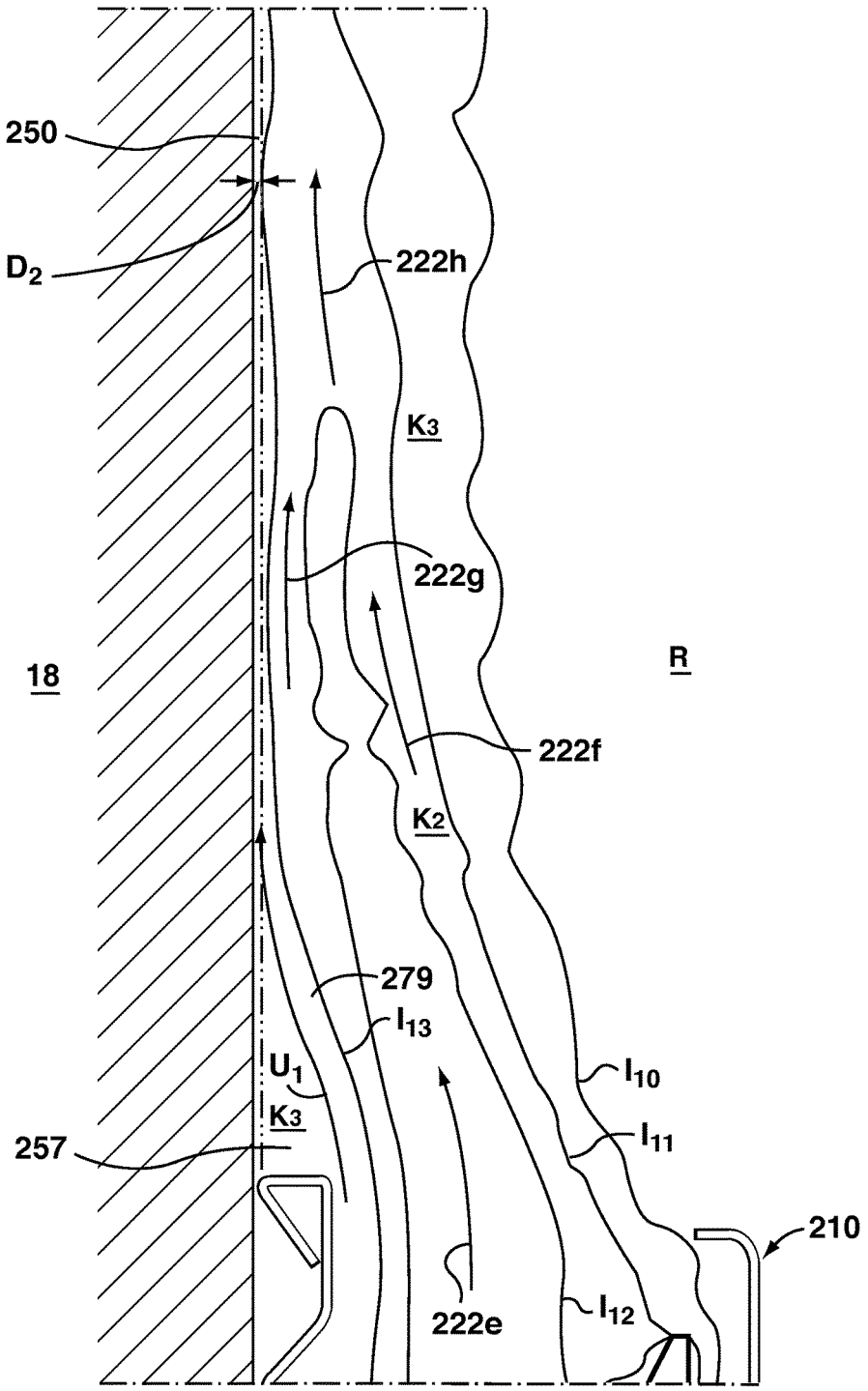
FIG. 5B is a side view of the wall above the heater assembly of FIG. 5A and a boundary layer of air adjacent to the wall, drawn at a larger scale.
Figure 5C:
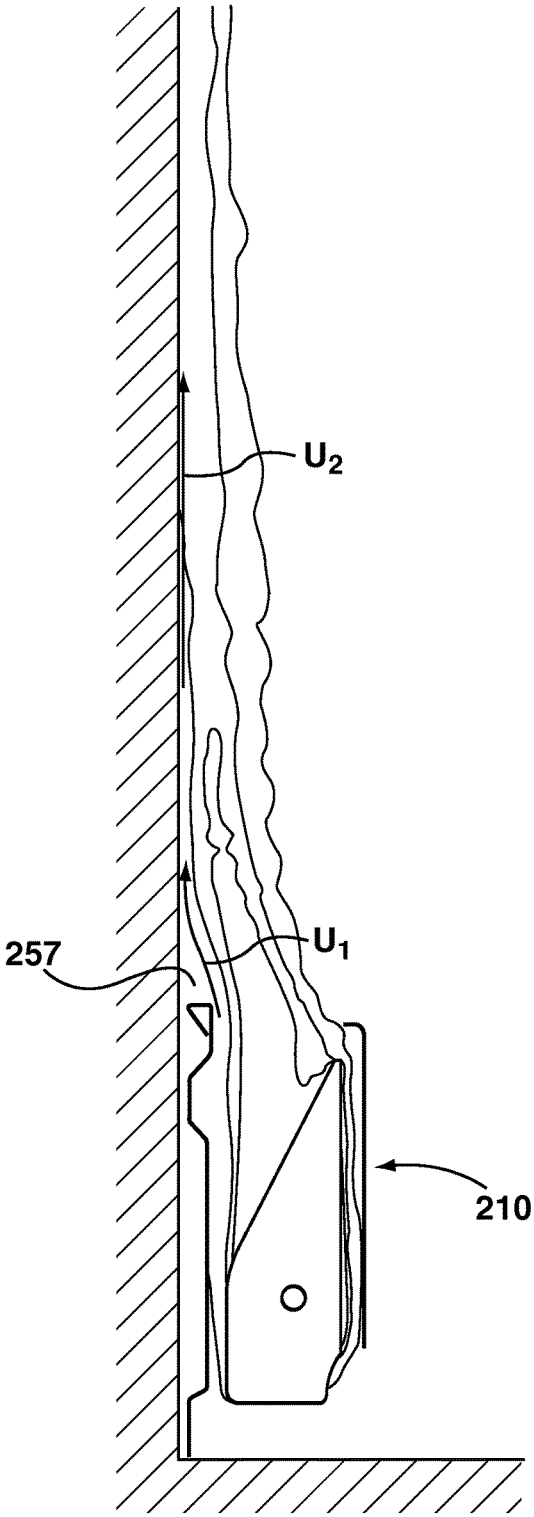
FIG. 5C is a side view of the heater assembly of FIG. 4, drawn at a smaller scale.

In the attached drawings, like reference numerals designate corresponding elements throughout. Reference is made to FIGS. 4-6 to describe an embodiment of a heater assembly in accordance with the invention indicated generally by the numeral 210. The heater assembly 210 preferably is located at the substantially vertical wall 18, for heating air in the room R at least partially defined by the wall 18. Preferably, the heater assembly 210 includes one or more heating elements 214 to provide heat, and one or more heat transfer elements 212 mounted on the heating element 214. Each heat transfer element 212 is for transferring heat from the heating element 214 to a column 244 of the air moving substantially upwardly past the heat transfer element 212. The column of air 244 preferably includes an inner portion 246 positioned proximal to the wall 18 and an outer portion 248 positioned distal to the wall 18, as will be described. Preferably, each heat transfer element 212 is formed to transfer substantially more heat to the outer portion 248 of the column of air 244 than to the inner portion 246 thereof, to cause the outer portion 248 to rise faster than the inner portion 246, for at least partially entraining the inner portion with the outer portion, so that at least a part of the inner portion 246 forms a laminar boundary layer 250 (FIGS. 5A, 5B) flowing along the wall 18.

It is believed that the inner portion is at least partially entrained with the outer portion due to temperature differences across the column of air. Because the outer portion is warmer than the inner portion, as the heat transfer elements are cleared, the outer portion has a higher velocity (i.e., generally upwardly) than the inner portion. Due to the higher velocity of the outer portion, a region of relatively lower air pressure is created, and at least part of the higher pressure air (being part of the inner portion, rising at a lower velocity) is drawn to the lower pressure region, i.e., outwardly from the wall.

The movements of the inner and outer portions 246, 248 of the column 244 are schematically represented by arrows "A" and "B" respectively in FIG. 4, as will be described. The movement of the air into and from the heater assembly is generally due to natural convection. As the air moves upwardly past the heat transfer elements, a temperature differential across the column of air is created, with the outer portion being heated to a higher temperature than the inner portion. Due to the temperature differential, part of the inner portion is drawn outwardly (i.e., away from the wall) as the column clears the heat transfer elements, and this has a significant impact on the flow of the column above the heater assembly 210, as will be described.

In one embodiment, the heater assembly 210 additionally includes a housing 224 at least partially defining a cavity 226 therein in which the heating element(s) 214 and the heat transfer element(s) 212 mounted thereon are receivable. The housing 224 preferably includes one or more inlets 252 through which the air forming the column 244 enters into the housing 224, and one or more outlets 254 through which the column 244 of warmed air exits the housing 224. As can be seen in FIGS. 4, 5A, and 5B, upward movement of the column of warm air 244 through the outlet 254 preferably is substantially unobstructed, for substantially laminar flow of the column 244 as it exits the heater assembly 210. It will be understood that, in one embodiment, a grate subassembly 286 (FIGS. 7, 11) preferably is positioned in or on the outlet 254, as will be described. The grate subassembly 286 is omitted from FIGS. 4-6 for clarity of illustration.

As can be seen in FIG. 4, in one embodiment, the housing 224 preferably includes an inner part 228 attachable to the wall 18 and an outer part 230, the inner and outer parts 228, 230 at least partially defining the cavity 226. Specifically, the inner and outer parts 228, 230 preferably include inner surfaces 260, 262 respectively which define the cavity 226.

As shown in FIG. 4, in one embodiment, it is preferred that the inner part 228 is attached to the wall 18. The manner in which the inner part 228 is attached to the wall 18 is well known in the art, and further discussion of this aspect is therefore not necessary. It will be appreciated by those skilled in the art that attaching the heater assembly 210 to the wall 18 is not necessary, i.e., the heater assembly 210 may be portable.

As can be seen in FIG. 4, the outlet 254 preferably is defined by the inner and outer parts 228, 230. In one embodiment, the inner part 228 preferable includes a first upper end portion 264 that is substantially planar, and also is positioned substantially vertical, i.e., substantially parallel to the wall 18. The first upper end portion 264 preferably is spaced apart from the wall 18 by a second upper end portion 265, which is positioned substantially orthogonal to the wall 18. Preferably, the second upper end portion 265 locates the first upper end portion 264 at a minimum predetermined distance $D_1$ apart from the wall 18 (FIG. 4).

In one embodiment, the outer part 230 preferably also includes an outlet edge 266. As shown in FIG. 4, the outlet 254 preferably extends between the first upper end portion 264 and the outlet edge 266. It has been found that the outlet 254 may be about 1.7 inches (42 mm) wide. Also, the first upper end portion 264 preferably is about 0.7 inches (18 mm) long, and the second upper end portion 265 preferably is about 0.2 inches (5 mm) long, i.e., the minimum predetermined distance $D_1$ preferably is about 0.3 inches (8 mm).

The heat transfer element 212 preferably is at least partially defined by inner and outer sides 236, 238 respectively, and top and bottom sides 240, 241 respectively (FIG. 4). As can be seen in FIGS. 4 and 5A, in one embodiment, the outer side 238 preferably is substantially longer than the inner side 236. Preferably, the sides 236, 238 and 240, 241 are any suitable length. For instance, in one embodiment, the heat transfer element has inner and outer sides 236, 238 that are approximately 1.3 inches (34 mm) and 3.7 inches (94 mm) in length respectively, and top and bottom sides 240, 241 that are approximately 2.6 inches (67 mm) and 1.5 inches (39 mm) in length respectively.

The heat transfer elements 212 preferably are made of any suitable material or materials with relatively good thermal conductivity, for example, aluminum. The heat transfer elements may have any suitable thickness, or thicknesses. Preferably, each heat transfer element has an approximate thickness of about 0.01 inches (0.3 mm).

In one embodiment, spaces "$S_1$", "$S_2$" preferably are defined respectively between the inner side 236 and the inner surface 260, and between the outer side 238 and the inner surface 262 (FIG. 4). The sides 236, 238 of the heat transfer element 212 preferably are spaced apart from the inner surfaces 260, 262 of the housing 224 respectively in order to limit the heat transferred from the heat transfer element 212 to the housing 224. As shown in FIG. 4, inside the housing 224, the column 244 extends between the inner surfaces 260, 262 of the inner and outer parts 228, 230 respectively.

It will be appreciated by those skilled in the art that portions 253, 255 of the column 244 rising through spaces $S_1$ and $S_2$ respectively are heated to approximately somewhat lesser extents than the inner and outer portions 246, 248 respectively of the column 244. The portions 253, 255 are schematically represented by arrows "E" and "F" (FIG. 4). In one embodiment, the distances between the heat transfer element 212 and the inner surfaces 260, 262 preferably are approximately 0.177 inch (0.45 cm) and 0.370 inch (0.94 cm). Preferably, the intake 252 is about 1.7 inches (44 mm) wide.

The heater assembly 210 preferably is similar to the conventional heaters 10, 110 in size, and is manufactured in such lengths as are desired. Preferably, the heating element 214 is any suitable source of heat. Those skilled in the art would be aware of various suitable sources of heat. For example, a suitable heating element 214 has been found to be a conventional electrical resistor (sheathed) heating element.

It is preferred that the heat transfer elements 212 at least partially define one or more first paths 256 along which at least a segment of the outer portion 248 of the column 244 travels as it is warmed, and one or more second paths 258 along which at least a segment of the inner portion 246 of the column 244 travels as it is warmed. Preferably, the first path 256 is substantially longer than the second path 258, so that substantially more heat is transferred to the outer portion 248 than is transferred to the inner portion 246. It is also preferred that the housing 224 is formed to permit the rising column 244 of warmed air to rise spaced apart from the wall 18 by at least the distance $D_1$ upon exiting the housing.

In FIG. 4, the inner portion (schematically represented by arrow "A") is shown flowing generally upwardly due to natural convection, but is drawn toward the outer portion (schematically represented by arrow "B") as the column of air 244 clears the heat transfer elements, due to the differential heating of the column by the heat transfer elements. As will be described, as the column of air moves upwardly above the heater assembly (i.e., due to natural convection), the effects of the differential heating appear to dissipate gradually. However, it appears that the effects of the differential heating are sufficient to move, in effect, turbulent flow at the wall sufficiently far up the wall that streaking is much decreased.

Figure 5D:
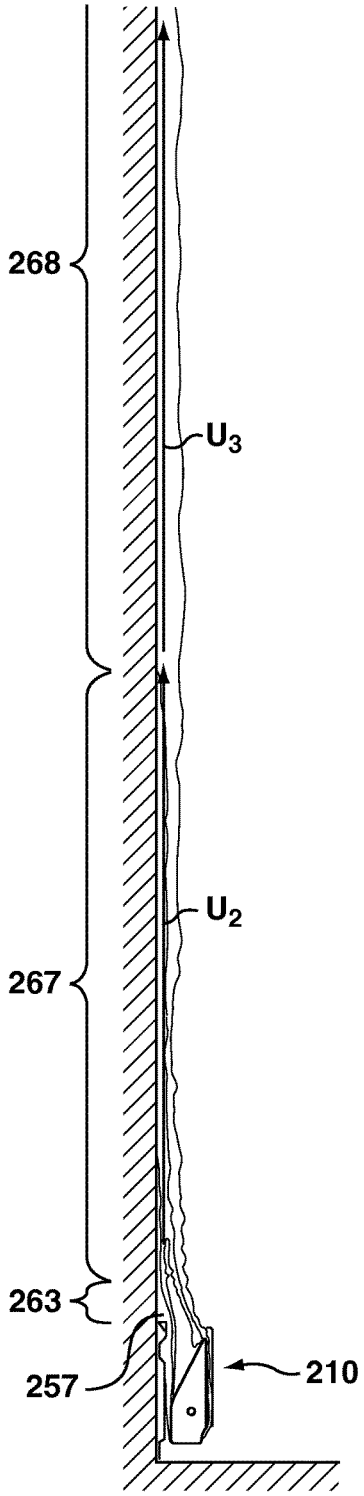
FIG. 5D is a side view of the heater assembly of FIG. 4, drawn at a smaller scale.
Figure 6:
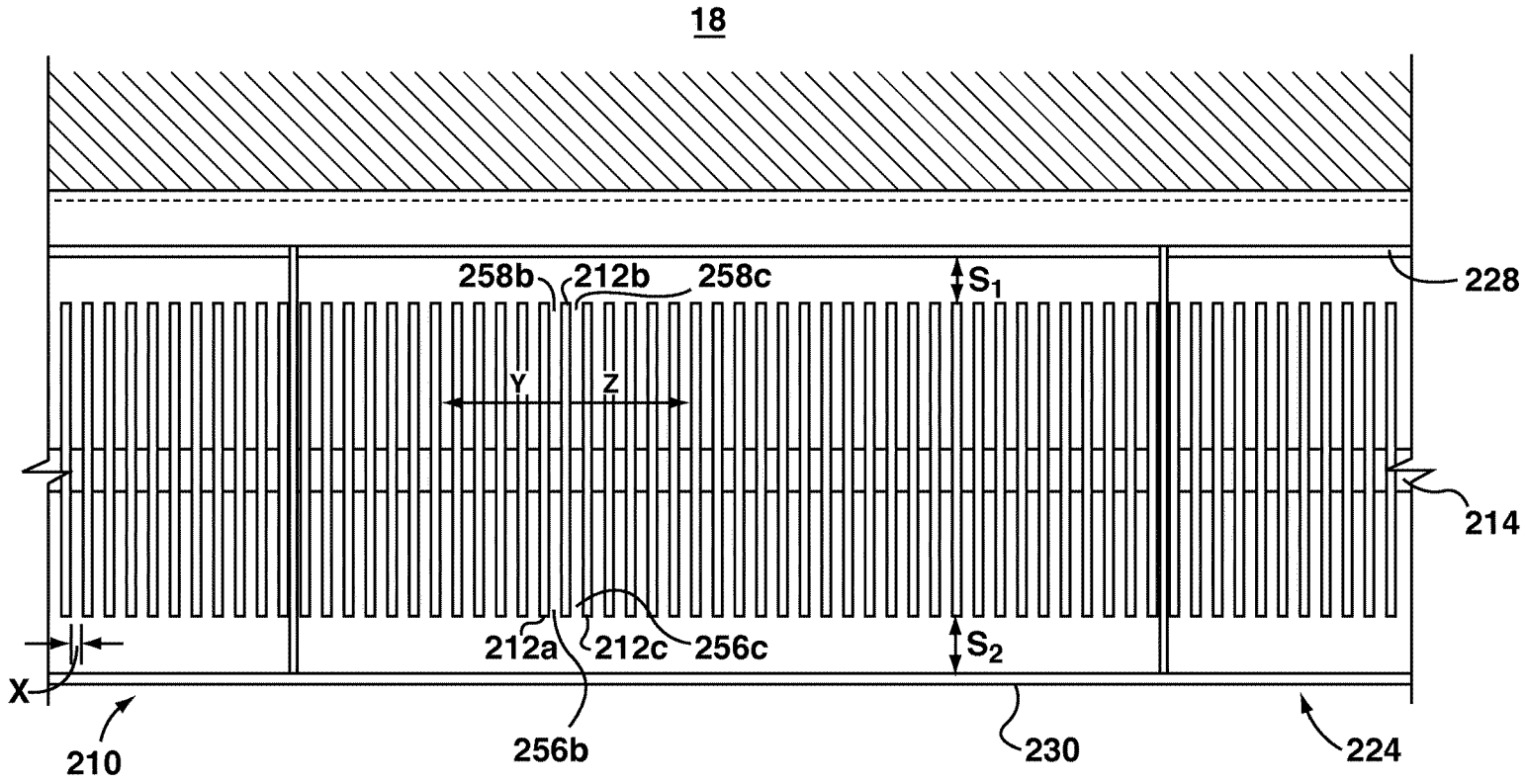
FIG. 6 is a top view of the heater assembly of FIG. 4, drawn at a larger scale.

As can be seen in FIG. 5D, three separate sub-regions 263, 267, and 268 of the region immediately adjacent to the wall 18 are identified. In the first sub-region 263, due to the positions of the first and second upper end portions 264, 265, a pocket 257 is defined in which the air is, to a limited extent, sheltered from the rising column of air.

It will be understood that the isotherms shown in FIGS. 5A-5D are approximate, being based on composites of computer-generated images including isotherms resulting from computer simulation (i.e., computational fluid dynamics) of the operation of the embodiment of the heater assembly 210 illustrated in FIG. 4. Those skilled in the art will understand that the directions of movement of different parts of the column of heated air by natural convection may be inferred from the isotherms. It will also be understood that the isotherms constantly vary over time in practice, and the isotherms in FIGS. 5A-5D represent only an idealized situation at a particular time which is believed to be representative.

Although a part of the inner portion is drawn toward the outer portion as the inner and outer portions clear the heat transfer elements, upon exiting the housing, a part 259 of the inner portion flows toward and along the wall. As illustrated in FIG. 5A, upon exiting the housing 224, the part 259 of the inner portion of the column 244 moves partially laterally toward the wall 18 after clearing the first upper end portion 264, while also moving upwardly. The movement of the part 259 of the column through the sub-region 263 is schematically represented by arrow "$U_1$", in FIGS. 5A, 5B, and 5C.

After moving past the sub-region 263, the part 259 of the column 244 at least partially forms the laminar boundary layer 250, moving upwardly along the wall 18. The movement of the boundary layer 250 through the sub-region 267 is schematically represented by arrow "$U_2$" (FIGS. 5C, 5D).

As is known, the laminar flow of the boundary layer 250 proceeds until it transitions into a turbulent flow. This is thought to be due to the effect that the wall 18 has on the boundary layer, i.e., viscous forces ultimately result in the boundary layer disintegrating into turbulent flow.

For illustrative purposes, in FIG. 5D, the transition to turbulent flow is shown as taking place at the boundary between the sub-regions 267 and 268. The turbulent flow of the warmed air substantially upwardly along the wall 18 in the sub-region 268 is schematically represented by arrow "$U_3$" (FIG. 5D).

Based on the testing completed to date, it appears that embodiments of the invention have a significantly reduced tendency to cause streaking, as compared to the baseboard heaters of the prior art. In addition, testing has shown that even a relatively small irregularity (e.g., a grate with a bent portion thereof) can cause sufficient turbulence immediately above the heater to cause some streaking.

From the foregoing, it can be seen that the heater assembly 210 avoids creating streaking on the wall 18 at least partly because of the manner in which the inner portion is partially pulled outwardly from the wall as the column is warmed, and because of the substantially vertical position and planar configuration of the first upper end portion 264. This results in, first, the sub-region 263, in which the air in the pocket 257 proximal to the wall 18 is substantially static. Second, in the sub-region 267, there is laminar flow of the boundary layer 250. Thirdly, in sub-region 268 (i.e., at a substantial distance above the heater 210), turbulent flow develops at the wall 18.

In addition, as will be described further below, the heater assembly 210 preferably includes the grate subassembly 286, which has relatively small elements therein. It is believed that, because the elements of the grate subassembly 286 are relatively small, the consequences of the Coanda effect as the column 244 rises through the grate subassembly 286 are relatively insignificant.

It is believed that the flow of the boundary layer 250 in the sub-region 267 is laminar partly because of the manner in which at least part of the inner portion is pulled toward the outer portion as the column is differentially warmed, and also because the column is spaced apart from the wall 18 by the distance $D_1$ upon exiting the housing. These two factors, it is thought, result in the laminar flow of the boundary layer 250 in the sub-region 267.

The thickness of the boundary layer 250 in the sub-region 267 (i.e., while the boundary layer has laminar flow) varies, but is not less than a minimum distance $D_2$ (FIGS. 5A, 5B).

Although the laminar flow of the boundary layer transitions to turbulent flow at the sub-region 268, it appears that the invention achieves the goal of at least mitigating streaking by, in effect, repositioning the transition to turbulent flow in the boundary layer to a location which is farther up the wall than in the prior art. This has the beneficial effect that the air subjected to turbulent flow at the wall is substantially cooler than in the prior art. In particular, this would result in the air rising less rapidly when it becomes turbulent, so that the turbulent flow would be slower than in the prior art. Also, as the grate subassembly 286 includes relatively thin elements, the turbulent flow at the wall is spread along the length of the outlet. Accordingly, such turbulent flow as occurs at the wall is diffuse, as it is spread out over a relatively large area.

As described above, it is believed that streaking results from turbulent flow of relatively warm air a short distance above the prior art heater, in which dust and dirt particles impinge on the wall due to the turbulent flow, and such particles accumulate on the wall over time, to create discolored areas. However, because the heater assembly 210 in effect repositions the transition to turbulent flow to a location significantly further up the wall 18, less streaking results because the turbulent flow is less rapid than in the prior art, and ultimately, correspondingly fewer dust and dirt particles are attached to the wall than in the prior art.

A top view of one embodiment of the heater assembly 210 is provided in FIG. 6. (For clarity of illustration, the grate subassembly 286 is omitted from FIG. 6.) As can be seen in FIG. 6, the heat transfer elements 212 preferably are spaced apart from each other by a preselected distance "X" along the heating element 214. Preferably, each heat transfer element 212 is mounted directly onto the heating element 214, for transfer of heat energy via conduction. In this embodiment, the paths 256, 258 are located in the gaps X, i.e., the paths preferably are at least partially defined by adjacent heat transfer elements 212. For example, the heat transfer element identified for convenience in FIG. 6 as 212*b* is positioned between heat transfer elements also identified for convenience as 212*a* and 212*c*. As can be seen in FIG. 6, for instance, paths 256*b*, 258*b* are at least partially defined between the heat transfer elements 212*a*, 212*b*, and paths 256*c*, 258*c* are also at least partially defined between the heat transfer elements 212*b*, 212*c*.

The preselected distance X may be any suitable distance. In one embodiment, for instance, the heat transfer elements 212 preferably are positioned approximately 0.3 inches (8 mm) apart.

In FIG. 4, the path 258 is at least partially defined by the height ($L_A$) of the heat transfer element 212 proximal to the inner side 236. The flow of the inner portion 246 along the second path 258 and a short distance beyond it (i.e., a short distance above the heat transfer element 212) is schematically illustrated by arrow "A". Similarly, the first path 256 is at least partially defined by the height ($L_B$) of the heat transfer element 212 proximal to the outer edge 238 thereof. The flow of the outer portion 248 along the first path 256 and a short distance beyond (i.e., a short distance above the heat transfer element 212) is schematically illustrated by arrow "B".

In FIG. 4, the inner portion 246 is schematically illustrated as extending between the inner side 236 of the heat transfer element 212 and the center of the heat transfer element 212, represented by a center line "C" in FIG. 4. Similarly, the outer portion 248 is schematically illustrated as extending between the outer side 258 of the heat transfer element 212 and the center ("C") of the heat transfer element 212. It will be understood that, solely for clarity of illustration, the inner and outer portions 246, 248 are schematically illustrated as being distinct, and each as extending over about one-half of the heat transfer element 212. That is, solely for clarity of illustration, the first and second paths are both shown as extending to the center line "C". Those skilled in the art will appreciate that, in practice, a precise boundary between the inner and outer portions 258, 256 usually would not exist, and would not be static over time in any event. It will be understood that, because the top side 240 is at an acute angle to the horizontal, the column of air is warmed differentially across its width, i.e., the temperature in the column of air gradually increases (from outer side to inner side) at the top side 240, i.e., there is a temperature differential across the column. Accordingly, the column of air is a single column differentially warmed, i.e., upon exiting the heater assembly, the column is warmer at its outer side than at its inner side.

In use, when the heater assembly 210 is activated, heat is provided therein, in the heating element 214. As can be seen in FIG. 4, when the heater assembly 210 is operating, ambient air from the room R is drawn into the inlet 252, such ambient air being schematically represented by arrows 222*a*, 222*b*, 222*c*, 222*d* (FIGS. 4, 5A, 5B). The warmed air in the column 244 rising from the heater 210 is schematically represented by arrows 222*e*, 222*f*, 222*g* and 222*h* (FIG. 5A, 5B). Isotherms, based on computer-generated images (i.e., based on computational fluid dynamics), are identified in FIGS. 5A and 5B as $I_{10}$-$I_{14}$.

Heat may be generated or conveyed in any suitable manner. For instance, in one embodiment, the heating element 214 is a resistive heating element, and heat is generated by passing electrical current through the heating element 214. Those skilled in the art would be aware that heat may be generated or conveyed by the heating element 214 in various ways. A portion of the heat thus generated or conveyed preferably is transferred to the heat transfer element 212 by conduction, as the heat transfer elements 212 preferably are secured directly to the heating element 214. At least a part of such portion of heat conducted to the heat transfer element 212 preferably is radiated outwardly therefrom. For example, heat is radiated from the heat transfer element 212*b* in the directions indicated in FIG. 6 by arrows "Y" and "Z". Accordingly, as can be seen in FIG. 6, heat radiated from the adjacent heat transfer elements 212 warms the air directed along a particular path (e.g., 256*b*, between heat transfer elements 212*a* and 212*b*). As indicated above, the longer the path along which the air travels, the warmer the air is upon exiting the path. Because the outer path 256 is longer than the inner path 258, the outer portion 248 is warmer than the inner portion 248 when the column 244 exits the paths.

Also, because the outer portion is warmer than the inner portion, it is less dense, and therefore rises faster. The net result is that, after exiting the paths 256, 258, due to the temperature differential across the column, the outer portion 248 is the least dense and the fastest-rising part of the column. The inner portion 246 is at least partially pulled along in the wake of the outer portion 248.

As shown in FIG. 5B, a relatively thin boundary layer 250 (flowing laminarly) remains adjacent to the wall at a certain height above the housing, in the sub-region 267. This is because the column 244, upon exiting the first and second paths, is directed at least partially away from the wall 18, i.e., due to the inner portion's tendency to at least partially follow the outer portion. Upon exiting the housing 227, the column 244 is spaced apart from the wall 18 by at least the predetermined distance $D_1$.

Temperature distributions for the heated air rising from the heater assembly 210 based on computer modelling (i.e., computational fluid dynamics) are shown in FIGS. 5A and 5B. Regions K1, K2, and K3 are shown in FIG. 5A as being defined by temperature gradients respectively. The region identified as K1 is the warmest region, and the region identified as K3 is the coldest region, and the temperature of K2 is intermediate (FIG. 5A). Those skilled in the art will appreciate that the temperature gradients are not fixed in position, but instead will vary greatly over time while the heater assembly 210 is operating.

As noted above, in one embodiment, the inner surfaces 260, 262 of the housing of the heater assembly 210 are spaced apart from the heat transfer element 214 by distances $S_1$, $S_2$ respectively (FIG. 4). In this embodiment, portions 253, 255 of the column 244 rise through the spaces inside the housing 224 between the heat transfer element 214 and the inner surfaces 260, 262. The portion 253 is proximal to the inner portion 246 of the column 244, and the portion 255 is proximal to the outer portion 248. Heat radiated from the heat transfer elements 214 is transferred to the portions 253, 255. However, because it is not located between heat transfer elements 214, the portion 253 is not warmed to the extent that the inner portion 246 is warmed, and likewise the portion 255 is not warmed to the extent that the outer portion 248 is warmed. It is believed that, upon the column 244 exiting the heater assembly 210, the portions 253, 255 do not have a significant effect on the overall direction or rate of movement of the column 244.

Preferably, the heater assembly 210 includes one or more heat transfer subassemblies 274 (FIG. 5) for transferring heat to the column of air 244 positioned therein. Each heat transfer subassembly 274 preferably is located at the wall 18. It is preferred that each heat transfer subassembly 274 includes the heating element(s) 214, to provide heat. The heat transfer element 212 preferably is formed for transferring heat from the heating element 214 to the outer portion 248 of the column 244 (located distal to the wall 18), and to the inner portion 246 (located proximal to the wall 18). Preferably, the heat transfer element 212 is also formed to transfer substantially more heat to the outer portion of the column than to the inner portion, to cause the outer portion to rise faster than the inner portion, thereby drawing the inner portion toward the outer portion so that at least a part of the inner portion 246 forms the laminar boundary layer 250 along the wall 18. Preferably, the heat transfer subassembly 274 includes a number of heat transfer elements 212 attached to the heating element 214.

In one embodiment, each heat transfer element 212 preferably at least partially defines the first path 256, along which at least a first segment 269 of the outer portion 248 travels, and the second path 258, along which at least a second segment 271 of the inner portion 246 travels (FIG. 4). Preferably, and as shown in FIGS. 4 and 5A, the first path 256 is substantially longer than the second path 258, for transferring more heat to the outer portion 248 than to the inner portion 246.

In FIG. 4, the inner portion 246 is illustrated as moving in a partially lateral direction upon exiting the second path 258, to indicate that at least part of the inner portion follows the outer portion above the heat transfer element. However, as illustrated, the heat transfer element 212 has a substantially planar surface. It will be understood that, in practice, part of the inner portion 246 may move laterally toward the outer portion before exiting the heater subassembly 274.

As can be seen in FIG. 6, the heater assembly 210 preferably includes one or more heating elements 214 to provide heat and a number of heat transfer elements 212 mounted on the heating element(s) 214, for transferring heat from the heating element(s) to the column of air 244 moving substantially upwardly past the heat transfer elements 212. In one embodiment, each heat transfer element 212 includes the inner side thereof 236 positionable proximal to the wall and the outer side 238 positionable distal to the wall, when the heater assembly 210 is located proximal to the wall 18. Each heat transfer element 212 preferably is formed to transfer more heat to the outer portion 248 than to the inner portion 246 of the column 244, thereby causing the outer portion 248 to rise faster than the inner portion 246, to at least partially entrain the inner portion with the outer portion, for laminar flow of at least a part of the inner portion along the wall 18. Preferably, each heat transfer element 212 is formed to position the inner portion 246 at the minimum predetermined distance $D_1$ from the wall 18 as the column 244 exits the heater assembly 210.

Preferably, the heat transfer elements at least partially define a number of first paths 256 respectively along which at least portions of the outer portion 248 of the column 244 are directed as the outer portion is warmed by the heat transfer elements. In one embodiment, it is also preferred that the first paths are longer than a number of second paths which are at least partially defined by the heat transfer elements respectively along which the inner portion of the column is directed. Also, each heat transfer element preferably is substantially taller at the outer side 238 thereof than at the inner side 236 thereof, the first and second paths 256, 258 being configured so that the outer and inner portions 248, 246 respectively exit therefrom proximal to the outer and inner sides respectively of each heat transfer element 212.

It is preferred that each first path 256 and second path 258 are at least partially defined by the heat transfer elements which are positioned adjacent to each other. As can be seen in FIG. 4, in one embodiment, the heater assembly 210 preferably also includes the housing 224, which at least partially defines the cavity therein in which the heating element(s) and the heat transfer elements mounted thereon are receivable. Preferably, the housing 224 includes one or more inlets 252 through which the air forming the column of warmed air enters into the housing 224, and one or more outlets 254 through which the column 244 of warmed air exits the housing. Preferably, upward movement of the column of warmed air through the outlet(s) 254 is substantially unobstructed, resulting in substantially laminar flow of the column as the column exits the housing 224.

It is also preferred that the housing 224 locates the column 244 spaced apart from the wall 18 by the minimum predetermined distance $D_1$ upon the column exiting the housing 224.

Figure 7:
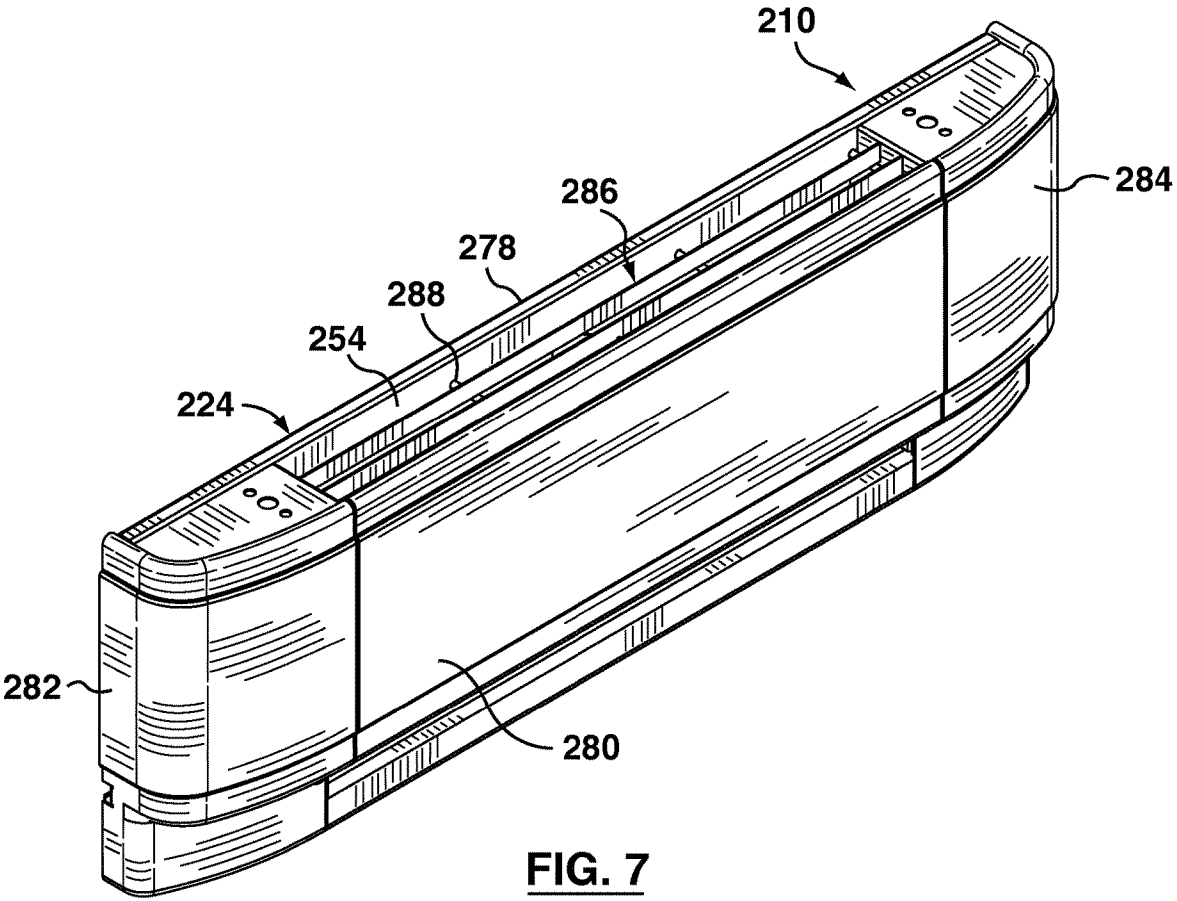
FIG. 7 is an isometric view of an embodiment of the heater assembly of the invention.
Figure 8:
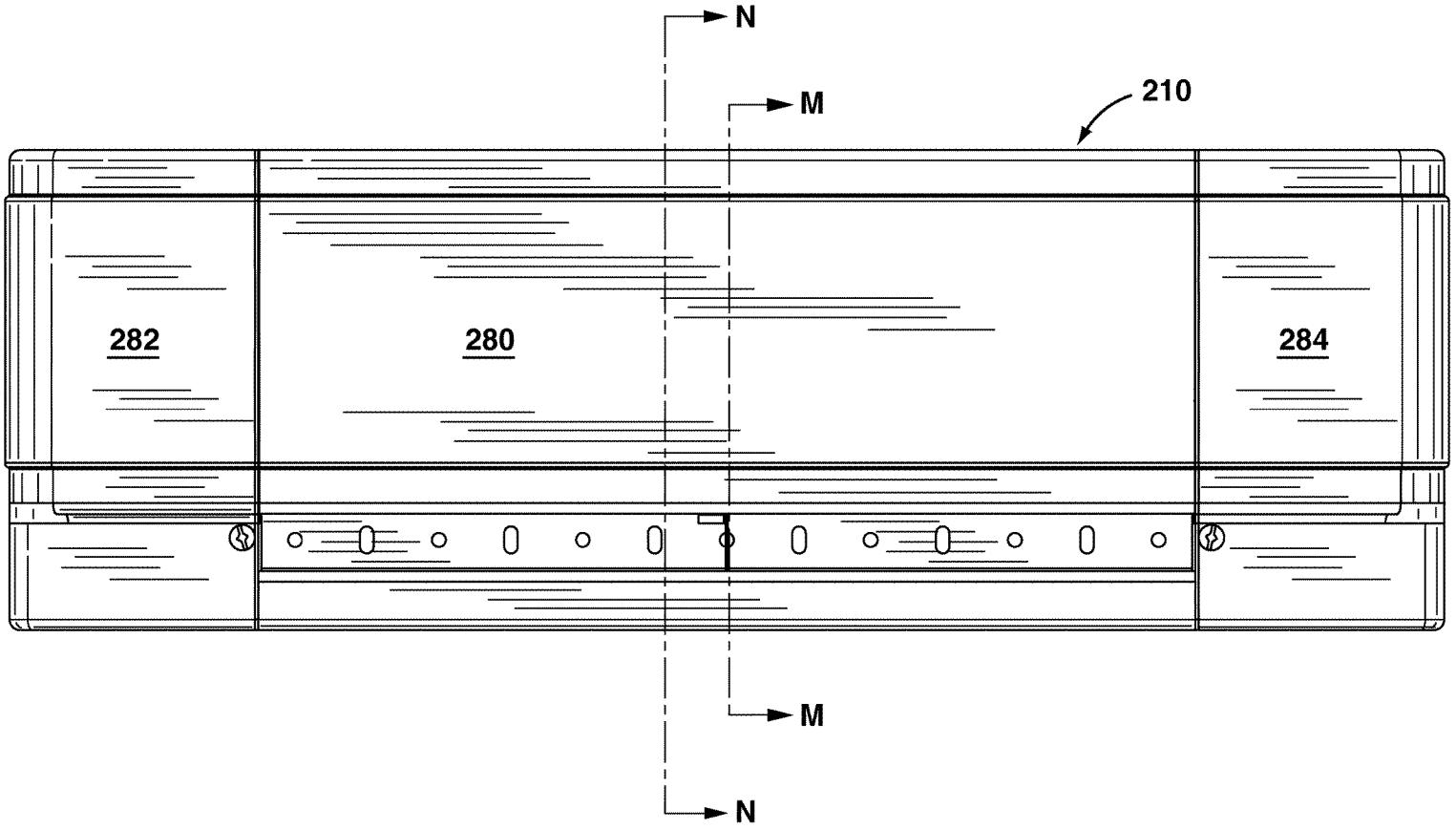
FIG. 8 is a front view of the heater assembly of FIG. 7.

As can be seen in FIG. 7, in one embodiment, the housing 224 includes a rear panel 278, a front panel 280, and end portions 282, 284 which fit onto ends of the front panel 280 and also onto the rear panel 278. As can also be seen in FIG. 7, the rear and front panels 278, 280 preferably define the outlet 254 therebetween (FIG. 4). In one embodiment, the housing 224 preferably also includes the grate subassembly 286, positioned in the outlet 254.

Figure 11:
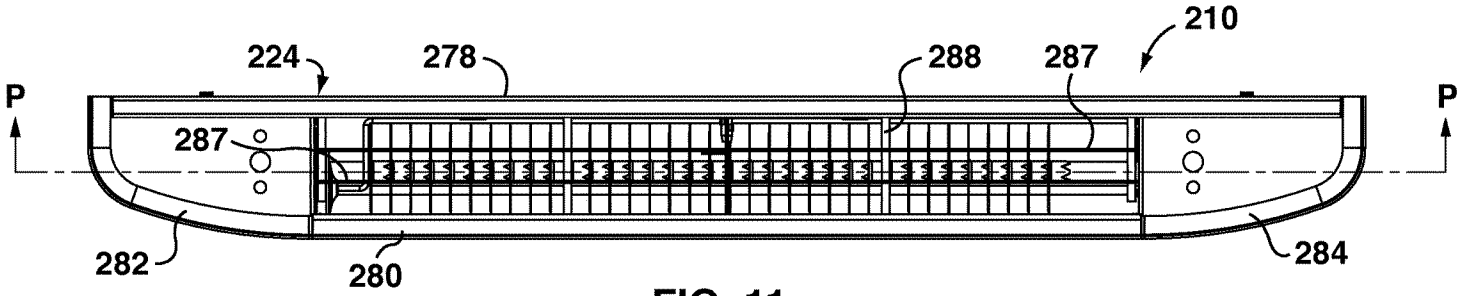
FIG. 11 is a top view of the heater assembly of FIG. 7.
Figure 12:
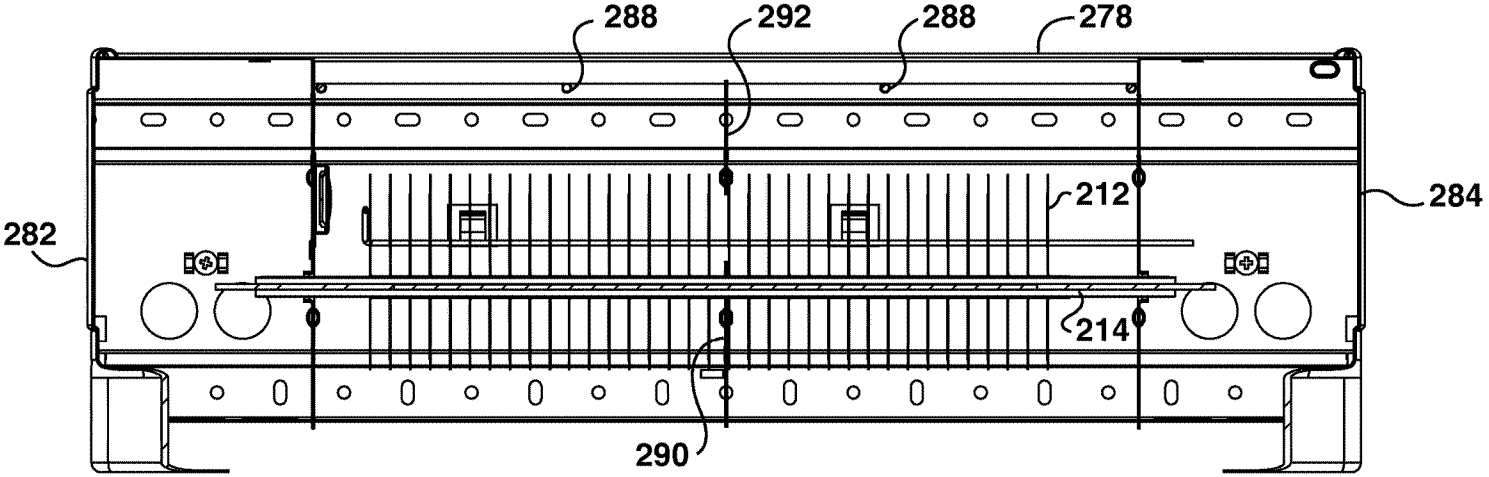
FIG. 12 is a cross-section taken along line P-P in FIG. 11.

As can be seen in FIGS. 11 and 12, the grate subassembly 286 preferably includes one or more elongate elements 287 and one or more transverse elements 288, the transverse elements 288 preferably being connected to the elongate elements 287 at intervals along the respective lengths of the elongate elements 287. The elongate elements 287 and the transverse elements 288 preferably are connected so that the transverse elements 288 support the elongate elements 287, and vice versa.

Figure 10:
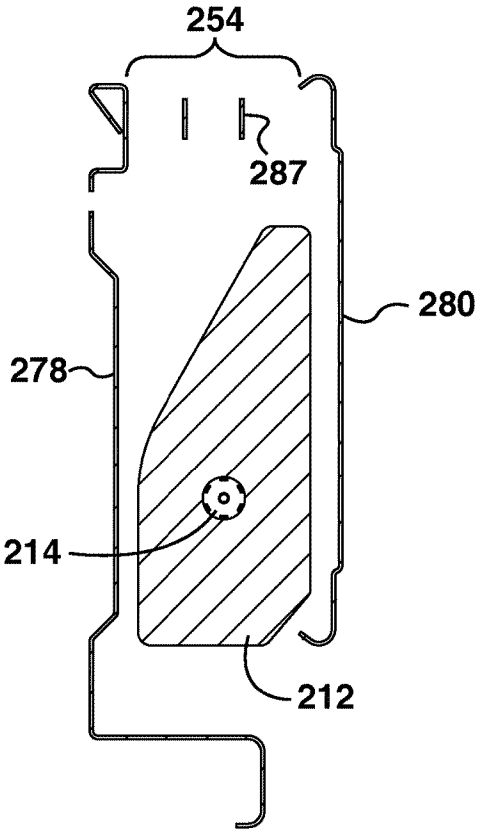
FIG. 10 is a cross-section of the heater assembly taken along line N-N in FIG. 8.
Figure 9:
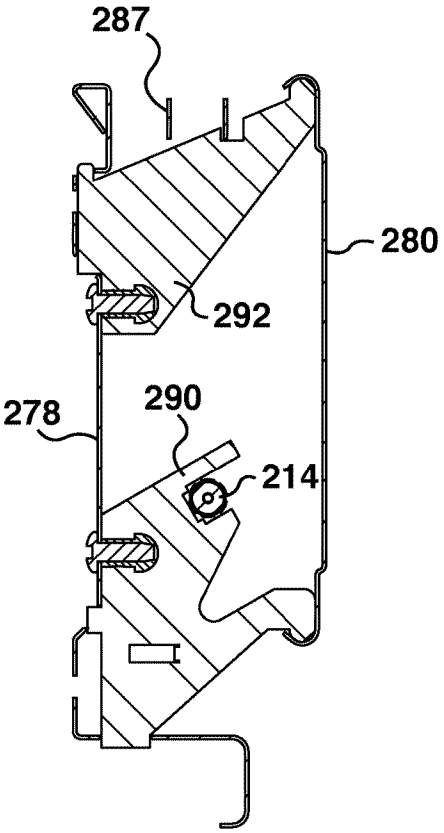
FIG. 9 is a cross-section of the heater assembly taken along line M-M in FIG. 8.

It is preferred that disruptions in the flow of air past the fins 212 and through the housing 224 are minimized. This is because of the importance of providing a substantially laminar flow of the column of warmed air as it exits the housing 224, to maintain the boundary layer 250 adjacent to the wall in the sub-region 267, above the heater assembly 210. Accordingly, and as can be seen in FIG. 10, the elongate elements 287 and the transverse elements 288 are formed for substantial nonobstruction of the movement of the column of air. Preferably, the grate elements 287, 288 are relatively thin, to minimize the introduction of turbulence into the column of warm air.

Those skilled in the art would be aware that, depending on the application, the elongate elements 287 and the transverse elements 288 may have a variety of shapes, in cross-section. For instance, and as can be seen in FIGS. 7 and 9-12, each elongate element 287 is substantially rectangular in cross-section, and each transverse element 288 is substantially round in cross-section. In one embodiment, it is preferred that the elongate element 287 is approximately 0.04 inches (1 mm) wide and approximately 0.4 inches (9 mm) tall. Also, it is preferred that the transverse element has a diameter of approximately 0.125 inches (3.2 mm).

As can be seen in FIGS. 11 and 12, in one embodiment, the transverse elements 288 preferably extend between the rear panel 278 and the front panel 280 (FIG. 11). From the foregoing, it will be appreciated by those skilled in the art that the smaller transverse elements 288 cause much less disruption to the upward flow of warm air exiting via the outlet 254, therefore causing much less turbulence in the region above the housing. Also, and as can be seen in FIG. 11, the elongate elements 287 are formed to extend substantially across the outlet 254.

Similarly, other elements in the housing which are in a position to potentially affect the air flow are to be made as small, and/or thin, as possible, to minimize disruption to the air flow. For instance, the housing 224 preferably includes one or more lower support elements 290 (for supporting the heating element 214) and one or more upper support elements 292 for supporting the grate subassembly 286. As can be seen in FIG. 12, the lower and upper support elements 290, 292 preferably are relatively thin. For instance, it has been found that lower and upper support elements 290, 292 which are approximately 0.04 inches (0.9 mm) thick, are suitable.

Figure 13:
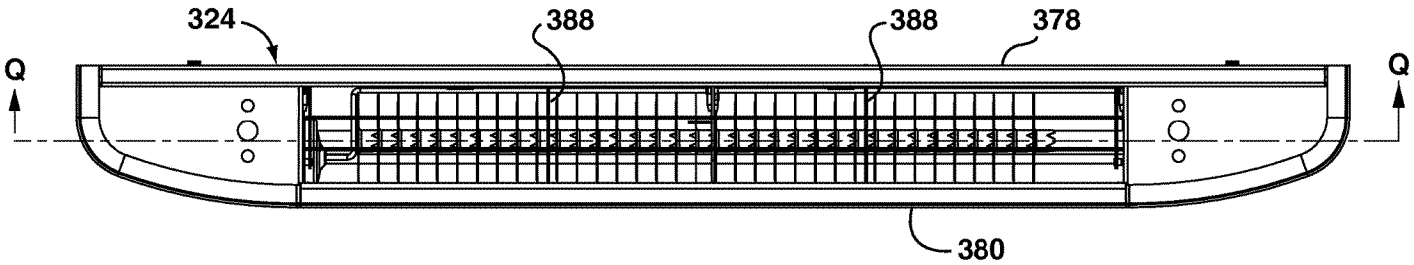
FIG. 13 is a top view of an alternative embodiment of the heater assembly of the invention.
Figure 14:
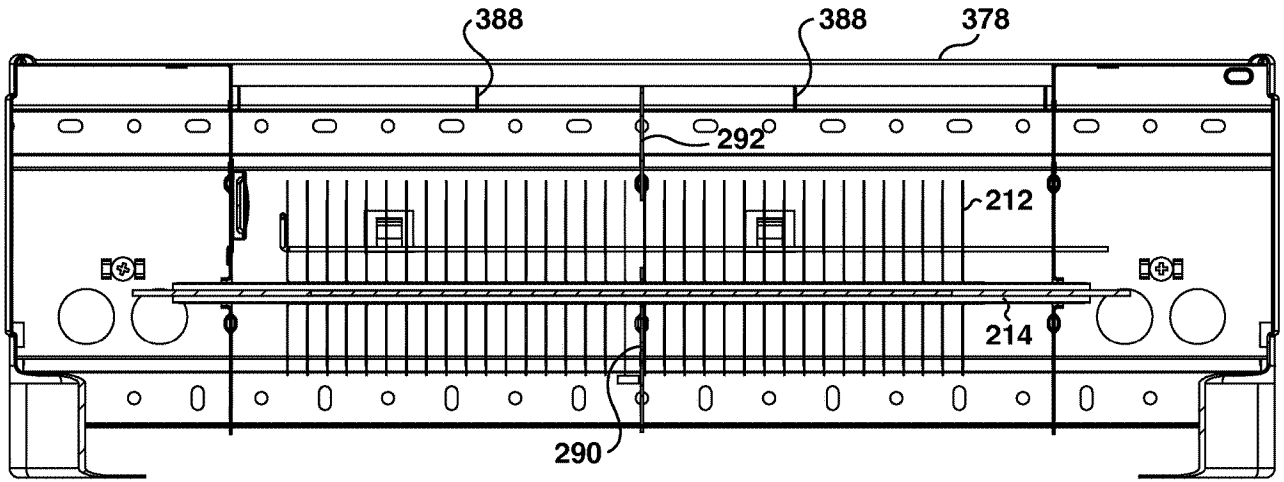
FIG. 14 is a cross-section of the heater assembly taken along line Q-Q of FIG. 13.

An alternative embodiment of the housing 324 is illustrated in FIGS. 13 and 14. The housing 324 extending between the rear panel 378 and the front panel 380 preferably includes substantially rectangular transverse elements 388. As can be seen in FIGS. 13 and 14, the ribs 388 are relatively thin. The relatively small thickness of each transverse element 388 is thought to be advantageous, as it is though to result in very little disruption to the upward flow of warm air through the outlet 354.

The transverse element 388 is substantially rectangular in cross-section. The transverse element 388 preferably has a thickness of approximately 0.04 inches (0.9 mm).

Figure 15:
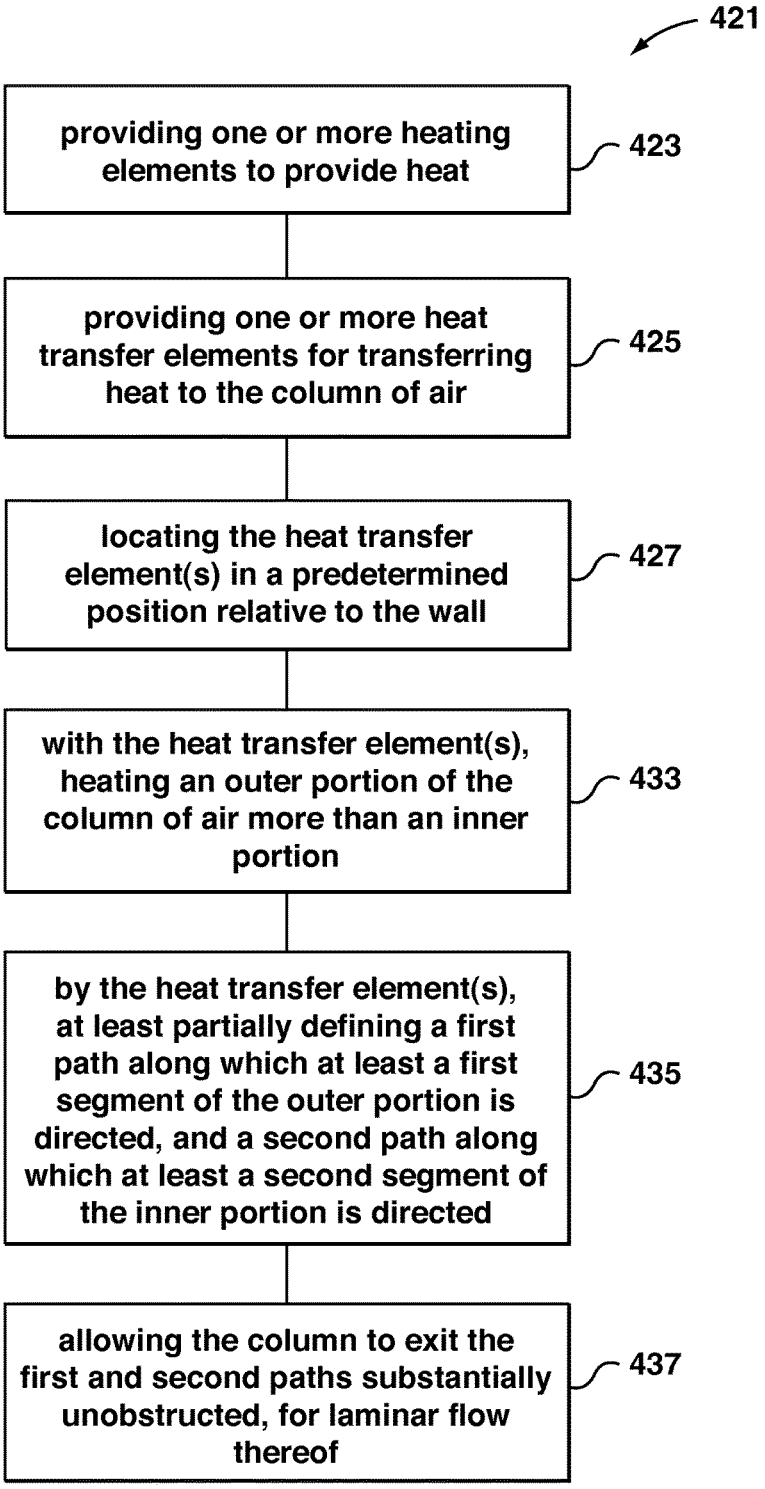
FIG. 15 is a flow chart schematically illustrating an embodiment of a method of the invention.

In one embodiment, a method 421 of heating air in the room at least partially defined by the substantially vertical wall 18 includes, first, the step of providing one or more heating elements 214 to provide heat (step 423, FIG. 15). Next, one or more heat transfer elements 212 are provided, for transferring heat from the heating element(s) 214 to the column 244 of air (step 425). Each of the heat transfer elements 212 preferably is located in a predetermined position relative to the wall 18 (step 427). Finally, with the heat transfer element(s), an outer portion of the column of air distal to the wall 18 is heated more than an inner portion of the column of air proximal to the wall 18, to cause the outer portion to rise faster than the inner portion, for at least partially entraining the inner portion with the outer portion, for laminar flow of at least a part of the inner portion along the wall (step 433).

From the foregoing, it can be seen that the predetermined position of the heat transfer element is with the inner side at about 0.4 inches (10 mm) from the wall.

In another embodiment, the method 421 preferably also includes the step of, by said at least one heat transfer element, at least partially defining a first path along which at least a first segment of the outer portion is directed, and a second path along which at least a second segment of the inner portion is directed (step 435). It is also preferred that the method of the invention includes allowing the column to exit the first and second paths substantially unobstructed, for laminar flow thereof (step 437).

From the foregoing, it can be seen that, in one embodiment of the heater assembly of the invention, the heater assembly preferably includes means 274 for accelerating at least a first segment of the outer portion relative to at least a second segment of the inner portion, to cause the outer portion to rise faster than the inner portion so that the inner portion is at least partially entrained by the outer portion, resulting in laminar flow of at least a part of the inner portion along the wall. Those skilled in the art would appreciate that various means for accelerating the outer portion relative to the inner portion may be used, including means not necessarily relying on the temperature differential across a column of air rising due to natural convection, described above. However, it is preferred that any such means for accelerating do not cause significant turbulence in the warmed air exiting the heater.

It will be understood that the heat transfer elements of the invention could be used in any heater assembly utilizing natural convection, i.e., such heat transfer elements could be used in heaters other than baseboard heaters which are located proximal to (or mounted onto) walls.

It will be appreciated by those skilled in the art that the invention can take many forms, and that such forms are within the scope of the invention as claimed. Therefore, the spirit and scope of the appended claims should not be limited to the descriptions of the preferred versions contained herein.

We claim:

1. A convection heater assembly to be located at a substantially vertical wall for heating air in a room at least partially defined by the wall, the convection heater assembly comprising:

at least one elongate heating element to provide heat, said at least one heating element being positioned substantially horizontally and substantially parallel to the wall;

a plurality of heat transfer elements substantially vertically positioned on said at least one heating element, each said heat transfer element being spaced apart from an adjacent one of the heat transfer elements adjacent thereto for transferring heat therefrom to columns of the air moving substantially upwardly past the heat transfer elements;

each said heat transfer element being at least partially defined by top and bottom sides thereof and by inner and outer sides thereof positioned proximal to the wall and distal to the wall respectively;

the bottom side being located at least partially orthogonal to the wall, and inner and outer sides being located substantially parallel to the wall;

the inner side extending upwardly to an inner side tip at a top end of the inner side;

the outer side extending upwardly to an outer side tip at a top end of the outer side above the inner side tip;

the top side of each said heat transfer element extending between the inner wall tip and the outer wall tip;

the heat transfer elements adjacent to each other guiding an outer portion of the column of the air rising therebetween along an outer path proximal to the outer sides thereof, and guiding an inner portion of the column of air along an inner path proximal to the inner sides thereof;

the outer path being longer than the inner path, whereby more heat is transferred to the outer portion than to the inner portion from the heat transfer elements guiding the column of air as the column of air moves upwardly therebetween, to cause the outer portion to rise faster than the inner portion;

a housing at least partially defining a cavity therein in which said at least one heating element and the heat transfer elements positioned thereon are located, the housing comprising at least one inlet through which the air enters into the housing, and at least one outlet through which the columns of warmed air exit the housing; and said at least one outlet being unobstructed for substantially vertical upwardly flow of the columns of warmed air from the heat transfer elements through said at least one outlet, permitting the cooler inner portion of each said column to be at least partially entrained by the warmer outer portion in each said column to provide substantially laminar flow of the columns of warmed air relative to the wall upon the columns exiting the convection heater assembly.

2. A convection heater assembly according to claim 1 additionally comprising a grate subassembly comprising at least one grate element formed for substantial nonobstruction of the upward movement of the columns of air therethrough.

3. A convection heater assembly according to claim 1 in which the housing is formed to locate the rising column of warmed air spaced apart from the wall by at least a minimum predetermined distance upon exiting the housing.

4. A convection heater assembly adapted to be located at a substantially vertical wall at least partially defining a room for heating air in the room, the convection heater assembly comprising:

at least one heating element to provide heat;

a plurality of heat transfer elements mounted on said at least one heating element and positioned substantially vertical and substantially parallel to each other, for transferring heat from the at least one heating element to respective columns of the air moving substantially upwardly between the heat transfer elements positioned next to each other respectively;

each said heat transfer element comprising an inner side located proximal to the wall and an outer side located distal to the wall;

each said heat transfer element being formed to direct an outer portion of the column rising adjacent thereto along an outer path proximal to the outer side thereof and to direct an inner portion of the column along an inner path proximal to the inner side of the heat transfer element and being substantially shorter than the outer path, for transferring relatively more heat to the outer portion than to the inner portion, whereby the outer portion rises faster than the inner portion and at least partially entrains the inner portion upon exit thereof from the convection heater assembly, for laminar flow of at least a part of the inner portion along the wall; and a housing at least partially defining a cavity therein in which said at least one heating element and the heat transfer elements mounted thereon are located, the housing comprising at least one inlet through which the air to form the columns of warmed air enters into the housing, and at least one outlet through which the columns of warmed air exit the housing unobstructed to permit substantially vertically upward movement of the columns of warmed air from the heat transfer elements through said at least one outlet.

5. A convection heater assembly according to claim 4 in which each said heat transfer element is formed to position the inner portion of each said column at a minimum predetermined distance from the wall as the column exits the convection heater assembly.

6. A convection heater assembly according to claim 4 in which each said heat transfer element is substantially taller at the outer side thereof than at the inner side thereof, the outer and inner paths being configured such that the outer and inner portions respectively exit therefrom proximal to the outer and inner sides respectively of the heat transfer elements.

7. A convection heater assembly according to claim 4 in which the housing locates the inner portions of the columns spaced apart from the wall by a minimum predetermined distance upon the column exiting the housing.

8. A convection heater assembly adapted to be mounted on a substantially vertical wall for heating air in a room at least partially defined by the wall, the heater assembly comprising:

at least one heating element to provide heat;

a plurality of heat transfer elements mounted substantially vertically on said at least one heating element for transferring heat from said at least one heating element to columns of the air moving substantially upwardly between adjacent ones of the heat transfer elements, each said column comprising an inner positioned proximal to the wall and an outer portion positioned distal to the wall;

each said heat transfer element being at least partially defined by inner and outer sides thereof and top and bottom sides thereof;

the outer side of each said heat transfer element being substantially longer than the inner side thereof, and each of the outer and inner sides extending between top ends thereof at the top side and bottom ends thereof at the bottom side, the outer sides at least partially guiding the outer portions of the columns of air rising between the heat transfer elements, and the inner sides at least partially guiding the inner portions;

the bottom side of each said heat transfer element being positioned at least partially orthogonally to the inner and outer sides thereof;

the top side extending between the top ends of the inner and outer sides to define an acute angle relative to the horizontal, such that more heat is transferred to the outer portion from each said heat transfer element respectively than to the inner portion, for substantially laminar flow of the columns of warmed air relative to the wall upon the columns of the air exiting the convection heater assembly; and a housing at least partially defining a cavity therein in which said at least one heating element and the heat transfer elements mounted thereon are located, the housing comprising at least one inlet through which the air to form the columns of warmed air enters into the housing, and at least one outlet through which the columns of warmed air exit, said at least one outlet being formed to permit the columns of warmed air to flow unobstructed therethrough substantially vertically from the heat transfer elements.

* * * * *